US010376732B2

(12) United States Patent
Garsdean

(10) Patent No.: US 10,376,732 B2
(45) Date of Patent: Aug. 13, 2019

(54) MOUNTABLE RESISTANCE EXERCISE DEVICE

(71) Applicant: Julian Garsdean, Burbank, CA (US)

(72) Inventor: Julian Garsdean, Burbank, CA (US)

( * ) Notice: Subject to any disclaimer, the term of this patent is extended or adjusted under 35 U.S.C. 154(b) by 0 days.

(21) Appl. No.: 16/270,932

(22) Filed: Feb. 8, 2019

(65) Prior Publication Data

US 2019/0168053 A1 Jun. 6, 2019

Related U.S. Application Data

(63) Continuation-in-part of application No. 15/786,537, filed on Oct. 17, 2017, now Pat. No. 10,220,261.

(51) Int. Cl.
*A63B 21/005* (2006.01)
*A63B 21/00* (2006.01)
(Continued)

(52) U.S. Cl.
CPC ..... *A63B 21/0058* (2013.01); *A63B 21/153* (2013.01); *A63B 21/16* (2013.01);
(Continued)

(58) Field of Classification Search
CPC ..... A63B 21/00058; A63B 21/00069; A63B 21/00076; A63B 21/00178; A63B 21/00181; A63B 21/00185; A63B 21/002; A63B 21/0023; A63B 21/005; A63B 21/0058; A63B 21/0059; A63B 21/012; A63B 21/0125; A63B 21/015; A63B 21/018; A63B 21/02; A63B 21/021; A63B 21/022; A63B 21/023; A63B 21/025; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/065; A63B 21/068; A63B 21/08; A63B 21/15; A63B 21/151; A63B 21/152; A63B 21/153; A63B 21/154; A63B 21/16;
(Continued)

(56) References Cited

U.S. PATENT DOCUMENTS 3,191,880 A * 6/1965 Visconti ..... A63B 69/0079 242/386
3,640,530 A * 2/1972 Henson ..... A63B 21/015 482/116

(Continued)

*Primary Examiner* — Gary D Urbiel Goldner
(74) *Attorney, Agent, or Firm* — Thomas I. Rozsa

(57) ABSTRACT

An exercise device for attachment to an exercise machine or as an independent stand alone exercise device that includes an enclosure having an outer wall that defines an internal space therein, at least one cable aperture and an attachment mechanism for attaching to the exercise machine. A winding assembly is rotationally captured within the internal space and includes a winding spool configured for receiving at least one cable wound there around under resistance provided by a motor. The motor is used in conjunction with a controller circuit, a power source, and a user interface. To perform exercises with the exercise device, a person sets a desired cable unwind resistance with the user interface and then repeatedly pulls and retracts the at least one cable.

11 Claims, 17 Drawing Sheets

(51) Int. Cl.
*A63B 23/12* (2006.01)
*A63B 21/16* (2006.01)

(52) U.S. Cl.
CPC ..... *A63B 21/4035* (2015.10); *A63B 23/12* (2013.01); *A63B 2225/50* (2013.01)

(58) Field of Classification Search
CPC ..... A63B 21/22; A63B 21/225; A63B 21/227; A63B 21/4017; A63B 21/4019; A63B 21/4021; A63B 21/4025; A63B 21/4027; A63B 21/4033; A63B 21/4035; A63B 21/4045; A63B 21/4047; A63B 21/4049; A63B 22/0076; A63B 2022/0079; A63B 23/035; A63B 23/03508; A63B 23/03516; A63B 23/03533; A63B 23/03541; A63B 23/12; A63B 23/1209; A63B 23/1245; A63B 23/1281; A63B 24/0062; A63B 24/0075; A63B 24/0087; A63B 2024/0065; A63B 2024/0068; A63B 2024/0071; A63B 2024/0078; A63B 2024/0081; A63B 2024/009; A63B 2024/0093; A63B 2024/0096; A63B 69/06; A63B 2069/062; A63B 71/0054; A63B 71/0619; A63B 71/0622; A63B 71/0686; A63B 2071/0063; A63B 2071/0072; A63B 2071/0081; A63B 2071/009; A63B 2071/065; A63B 2071/0658; A63B 2071/0661; A63B 2071/0675; A63B 2071/0683; A63B 2071/0694; A63B 2209/00; A63B 2209/08; A63B 2210/00; A63B 2210/50; A63B 2210/58; A63B 2220/10; A63B 2220/16; A63B 2220/17; A63B 2220/20; A63B 2220/24; A63B 2220/30; A63B 2220/34; A63B 2220/35; A63B 2220/36; A63B 2220/40; A63B 2220/44; A63B 2220/50; A63B 2220/51; A63B 2220/54; A63B 2220/58; A63B 2220/62; A63B 2220/64; A63B 2220/80; A63B 2220/801; A63B 2220/803; A63B 2225/09; A63B 2225/093; A63B 2225/096; A63B 2225/20; A63B 2225/50; A63B 2225/52; A63B 2225/54
See application file for complete search history.

(56) References Cited

U.S. PATENT DOCUMENTS 4,678,184 A * 7/1987 Neiger ..... A63B 21/0058 482/118
4,753,442 A * 6/1988 Bland ..... A63B 69/0079 273/330
4,912,638 A * 3/1990 Pratt, Jr. ..... A61B 5/1121 128/905
4,979,733 A * 12/1990 Prud'Hon ..... A63B 21/0058 482/4
5,304,104 A * 4/1994 Chi ..... A63B 21/0058 482/1
5,409,435 A * 4/1995 Daniels ..... A63B 21/0056 482/5
5,697,869 A * 12/1997 Ehrenfried ..... A63B 21/0058 482/129
5,738,611 A * 4/1998 Ehrenfried ..... A63B 21/023 482/129
6,210,348 B1 * 4/2001 Reed ..... A61H 1/0292 482/72
6,280,361 B1 * 8/2001 Harvey ..... A63B 21/025 482/101
8,013,457 B2 * 9/2011 Bulthaup ..... H02K 7/1853 290/1 R
8,075,453 B1 * 12/2011 Wilkinson ..... A63B 22/0005 482/51
8,093,731 B2 * 1/2012 Bulthaup ..... H02K 7/1853 206/37.1
8,845,499 B1 * 9/2014 Boatwright ..... A63B 21/015 482/116
9,833,662 B2 * 12/2017 Potter ..... A63B 24/0087
9,844,692 B2 * 12/2017 Rollins ..... A63B 21/0058
2002/0025891 A1 * 2/2002 Colosky, Jr. ..... A63B 21/025 482/127
2002/0086779 A1 * 7/2002 Wilkinson ..... A63B 21/00069 482/118
2008/0157637 A1 * 7/2008 Bulthaup ..... H02K 7/1853 310/75 R
2010/0197467 A1 * 8/2010 Hector ..... A63B 69/12 482/55
2011/0287910 A1 * 11/2011 Ladd ..... A63B 21/00069 482/127
2012/0053014 A1 * 3/2012 Zhu ..... A63B 21/00069 482/5
2013/0267384 A1 * 10/2013 Eldridge ..... A63B 24/0087 482/5
2013/0310230 A1 * 11/2013 Norris ..... A63B 21/018 482/115
2014/0038777 A1 * 2/2014 Bird ..... A63B 21/0058 482/5
2014/0113779 A1 * 4/2014 Loach ..... A63B 21/0004 482/115
2014/0194250 A1 * 7/2014 Reich ..... A63B 24/0062 482/5
2014/0194251 A1 * 7/2014 Reich ..... A63B 24/0087 482/6
2014/0287876 A1 * 9/2014 Etter ..... A63B 24/0087 482/5
2014/0342878 A1 * 11/2014 Hashish ..... A63B 21/0058 482/8
2015/0306459 A1 * 10/2015 Boyette ..... A63B 24/0075 482/5
2016/0101322 A1 * 4/2016 Potter ..... A63B 24/0087 482/6
2016/0158603 A1 * 6/2016 Darwood ..... G06F 19/3481 482/5
2016/0332019 A1 * 11/2016 Rollins ..... A63B 21/0058
2017/0333756 A1 * 11/2017 Bird ..... A63B 21/0058
2018/0001128 A1 * 1/2018 Norris ..... A63B 21/4035
2018/0021616 A1 * 1/2018 Orady ..... A63B 21/0059 482/5
2018/0021617 A1 * 1/2018 Krull ..... A63B 21/00069 482/128

* cited by examiner

MOUNTABLE RESISTANCE EXERCISE DEVICE

CROSS-REFERENCE TO RELATED APPLICATION

This patent application is a continuation-in-part (CIP) of Non-Provisional application Ser. No. 15/786,537 filed on Oct. 17, 2017, now pending.

BACKGROUND OF THE INVENTION

1. Field of the Invention

This invention relates to exercise devices, including manual exercise devices and electric resistance exercise devices.

2. Description of the Prior Art

Most exercise machines are designed for performing only a limited number of exercises thereon, focusing on a particular group of muscles. For example, exercise bicycles are focused on emulating a bicycle and replicating the manner in which a bicycle is used to strengthen leg muscles. Meanwhile, the arm muscles are essentially untouched when using a bicycle-type exercise machine. Many different types of exercise machines have a similar problem.

Therefore, there is a need for a device that can be mounted to an exercise machine to provide supplemental exercise of muscles not specifically targeted by the exercise machine. In addition, there is a need for a separate independent exercise machine which can be used to exercise muscles, either affixed to anther machine or used independently. To fulfill these requirements, such a device should be portable and lightweight, so that the device could be moved from machine to machine by the user if the user desires to use the machine in different locations. Alternately, multiple machines could be utilized on different exercise machines. The benefits of such a machine are that the machine would offer enhancements to create a full body workout.

SUMMARY OF THE INVENTION

The present invention is an exercise device for attachment to an exercise machine used by a person to perform exercises. Such an exercise machine may be an exercise bicycle, for example, wherein the person performs leg exercises using the exercise bicycle and performs supplemental arm exercises with the exercise device of the present invention.

In addition, the present invention is an exercise device that is used to provide resistance to a plurality of muscle groups as a stand alone exercise device or as a supplemental device that may be affixed to other exercise devices to facilitate supplemental exercises.

The exercise device includes a rigid enclosure having an outer wall that defines an internal space therein. The enclosure includes at least one cable aperture and attachment mechanism configured for selective attachment to the exercise machine. The attachment mechanism preferably includes at least one magnet fixed with the enclosure and configured for magnetically attaching to a magnetically-attractive surface of the exercise machine.

Alternately, or in addition, the attachment mechanism may include a mechanical clamp that is fitted into a dovetail slot.

A winding assembly of the exercise device is rotationally captured within the internal space of the enclosure and includes a winding spool configured for receiving a proximal end of at least one cable wound there around in a first rotational direction under the urging of a coil spring that has a winding spring tension. The winding spool rotates in an opposite, second direction when a distal end of the at least one cable is pulled away from the winding spool with sufficient force to overcome the winding spring tension, such as when pulled by the person while performing exercises.

The present invention may also be used with numerous other types of springs such as tension springs, compression springs, torsion springs, constant springs, variable springs, leaf springs or other commonly known springs capable of storing mechanical energy.

A motor is preferably included that has a rotational shaft fixed with a threaded screw shaft. A rotor plate is fixed with the screw shaft such that rotation of the motor moves the rotor plate either towards or away from the winding spool. A torsion spring is fixed between the rotor plate and the winding spool such that rotating the rotor plate causes the torsion spring to increase or decrease a cable unwind resistance, inhibiting or assisting the unwinding of the at least one cable from the winding spool. Preferably, the motor, threaded shaft, rotor plate, coil spring and the winding spool are all mutually coaxially aligned along a common longitudinal axis.

A controller circuit is fixed at least partially within the enclosure and is electrically connected with at least a power source, a user interface, and the motor. The power source is preferably one of a plurality of separately rechargeable battery packs such as are used with battery-operated power tools, or the like. Alternately the power source may be a power cord plugged into a wall outlet or an AC adapter, or the like. The user interface includes an input for changing the cable unwind resistance.

As such, to perform the exercises, the enclosure is fixed to the exercise machine at the attachment mechanism. The person sets the desired cable unwind resistance with the user interface and then pulls the at least one cable to unwind the at least one cable from the winding spool. The winding spring tension of the coil spring thereafter rewinds the at least one cable onto the winding spool when the person releases tension on the at least one cable. The person then pulls the at least one cable again to repeat the exercise.

Preferably, the distal end of the at least one cable is fixed with a grip element, such as an exercise bar, to facilitate the person pulling the at least one cable. The exercise device can alternately have two cables, each terminating at a handle.

The user interface of the controller circuit preferably includes at least a switch for increasing cable unwind resistance and a switch for decreasing cable unwind resistance. Such switches may be soft switches displayed on a touch-screen by a software application running on the controller circuit, at least one wireless remote, a smartphone, or the like. In some embodiments, the controller circuit includes a wireless transceiver to communicate with the at least one wireless remote or the smartphone through the use of commonly-used wireless protocols such as BLUETOOTH®, WIFI®, or the like, or other commonly known radio frequency (RF) communication.

Preferably, such a wireless remote is fixed proximate the distal end of the at least one cable, such that the person has ready access to the switches. For example, the at least one wireless remote may be incorporated into the handles so that while the person is exercising, he/she may increase or decrease the cable unwind resistance without stopping the exercise.

The present invention is an exercise device that is mounted to an exercise machine to provide supplemental exercise of muscles not specifically targeted by the exercise machine. The present device is portable and lightweight so that the device can be moved from machine to machine by the user if the user so desires. Alternately, multiple machines of the present invention can be utilized on different exercise machines. The present invention is relatively simple to use, and provides enhancements for use with the person's smartphone or a remote control so that resistance experienced by the person is easily adjusted while performing the exercises. In addition, the present invention can be used as a standalone exercise device.

Described in one embodiment, the present invention is a portable exercise device comprising: (a) a rigid enclosure having an outer wall that defines an internal space therein, the rigid enclosure includes a cable aperture; (b) a winding assembly rotationally captured within said internal spaced within said outer wall of said rigid enclosure, the winding assembly includes a first circular flange with a first rotational bearing, a second circular flange with a second rotational bearing, a winding spool for receiving a proximal end of a cable wound around the winding spool in a first rotational direction, the cable being affixed to a grip element at a distal end of the cable which extends out of said cable aperture, the cable unwind in a second rotational direction opposite the first rotational direction when the distal end of the cable is pulled away from the winding spool; (c) a stepper motor having a rotational shaft to which a rotor plate is fixed, a torsion spring connected to the rotational shaft between the rotor plate and the winding spool, a first end of the torsion spring being fixedly connected to the rotational shaft between the rotor plate and a second end of the torsion spring, opposite the first end of the torsion spring, being fixedly connected to the winding spool; whereby rotation of the stepper motor rotates the rotor plate and causes the torsion spring to respectively increase or decrease a cable unwind resistance that respectively inhibits or assists the unwinding of the cable from the winding spool, wherein the stepper motor, the rotational shaft, the rotor plate, the torsion spring, and the winding spool are contained within said internal space a said rigid enclosure; and (d) incremental resistance switches displayed on a touch-screen by a software application running on a controller circuit which includes a resistance selection interface ; (e) wherein a preset load rating may be selected on the touch-screen to facilitate incremental changes to the cable unwind resistance through said software application.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF EMBODIMENTS OF THE PRESENT INVENTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
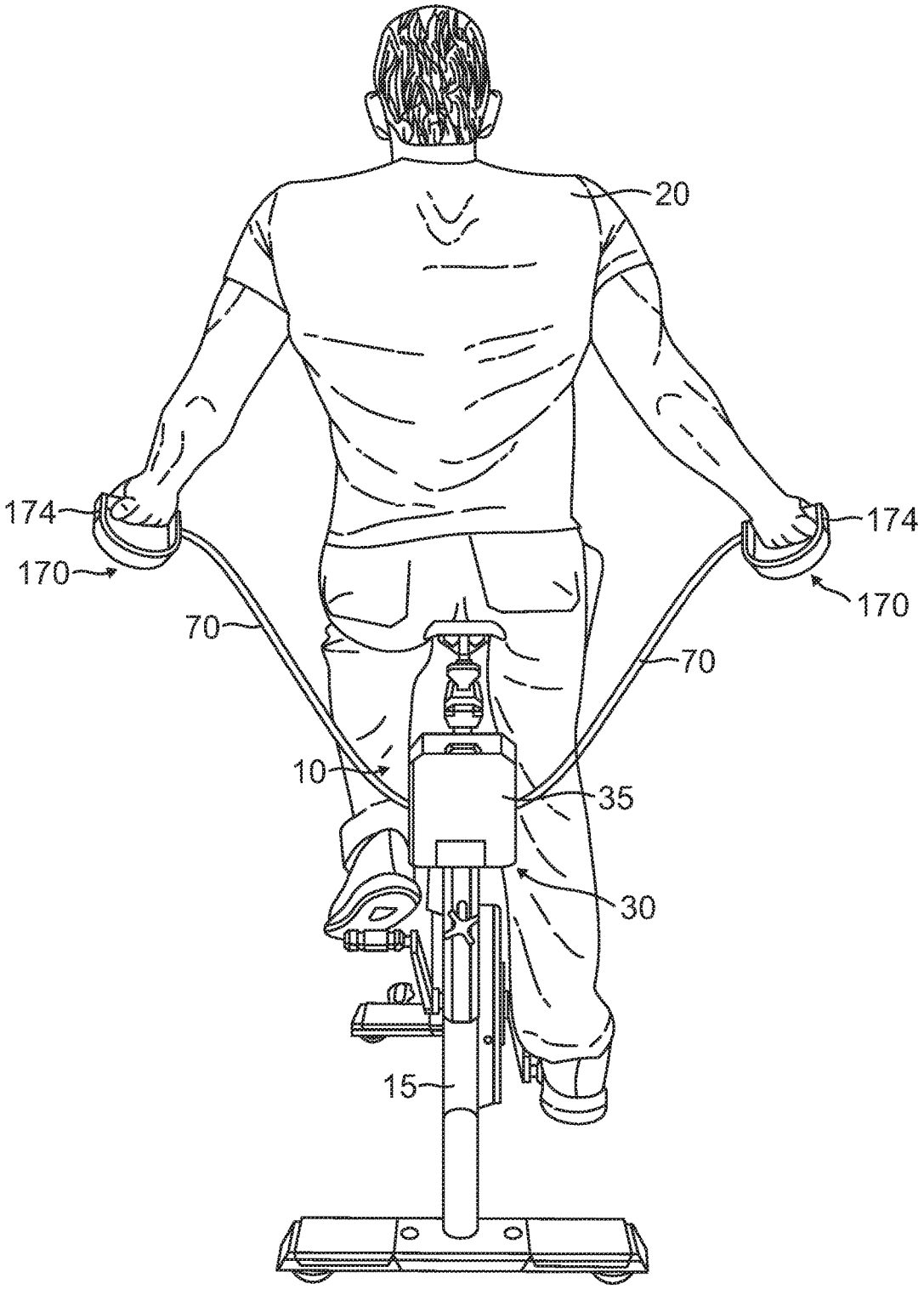
FIG. 1 is a rear elevational view of the invention, illustrated as being used by a person on an exercise bicycle.
Figure 2:
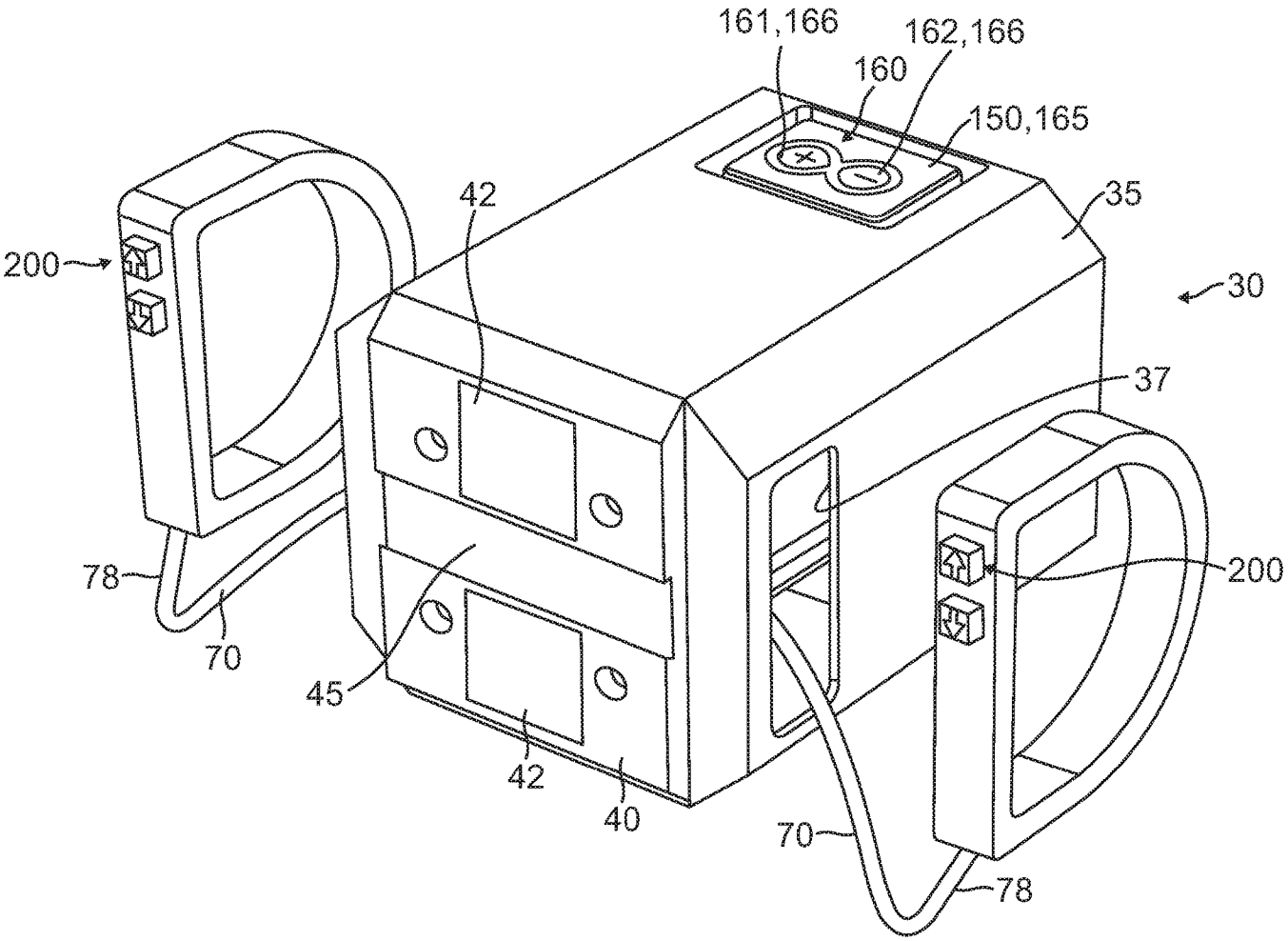
FIG. 2 is a front perspective view of the invention.
Figure 3:
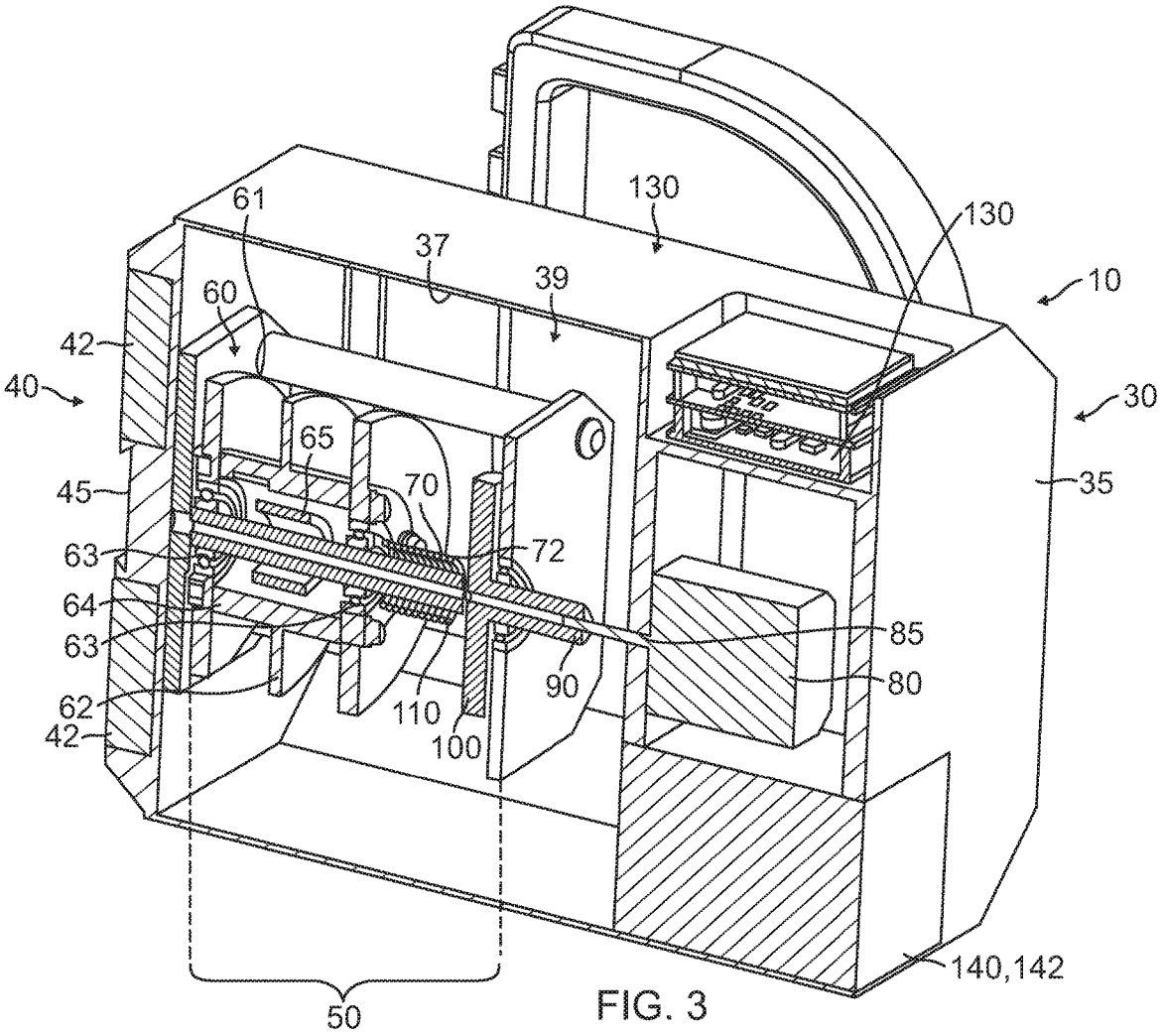
FIG. 3 is a cross-sectional view of the invention taken along a vertical plane through a rotational axis of a winding assembly and motor.
Figure 5A:
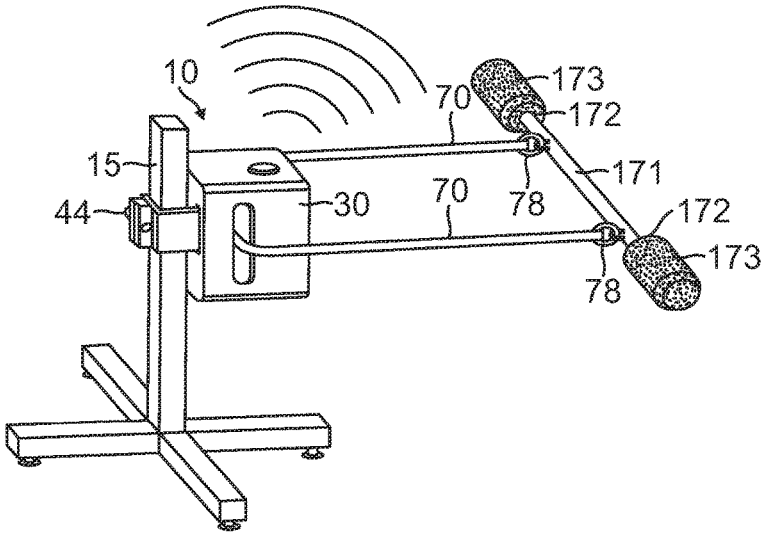
FIG. 5A is a perspective view of the invention as used on an alternate exercise machine, illustrating a wireless smartphone interface.

FIGS. 1-3 illustrate an exercise device 10 for attachment to an exercise machine used by a person 20 to perform exercises. Such an exercise machine 15 may be an exercise bicycle 15 as illustrated in FIG. 1, wherein the person 20 performs leg exercises using the exercise bicycle 15 and performs supplemental arm exercises with the exercise device 10 of the present invention. Alternately, as illustrated in FIG. 5A, the exercise machine 15 may be a post for mounting of the exercise device 10 of the present invention, or any other suitable exercise machine 15 currently known or that becomes available in the future. Alternatively, the present invention is used as a stand alone exercise device or is used as an exercise supplement by affixing the present invention to other exercise devices.

The exercise device 10 of the present invention includes a rigid enclosure 30 having an outer wall 35 that defines an internal space 39 therein. Such an enclosure 30 may have an openable side (not shown) or services components in the internal space 39, as is known in the art. The enclosure 30 includes an attachment mechanism 40 configured for selective attachment to the exercise machine 15, and at least one cable aperture 37. The attachment mechanism 40 preferably includes at least one magnet 42 fixed with the enclosure 30 and configured for magnetically attachment to a magnetically-attractive surface of the exercise machine 15. Alternatively, or in addition, the attachment mechanism may include a mechanical clamp 44 (FIG. 5A) that is fitted into a dovetail slot 45 (FIGS. 3 and 5A).

Figure 4A:
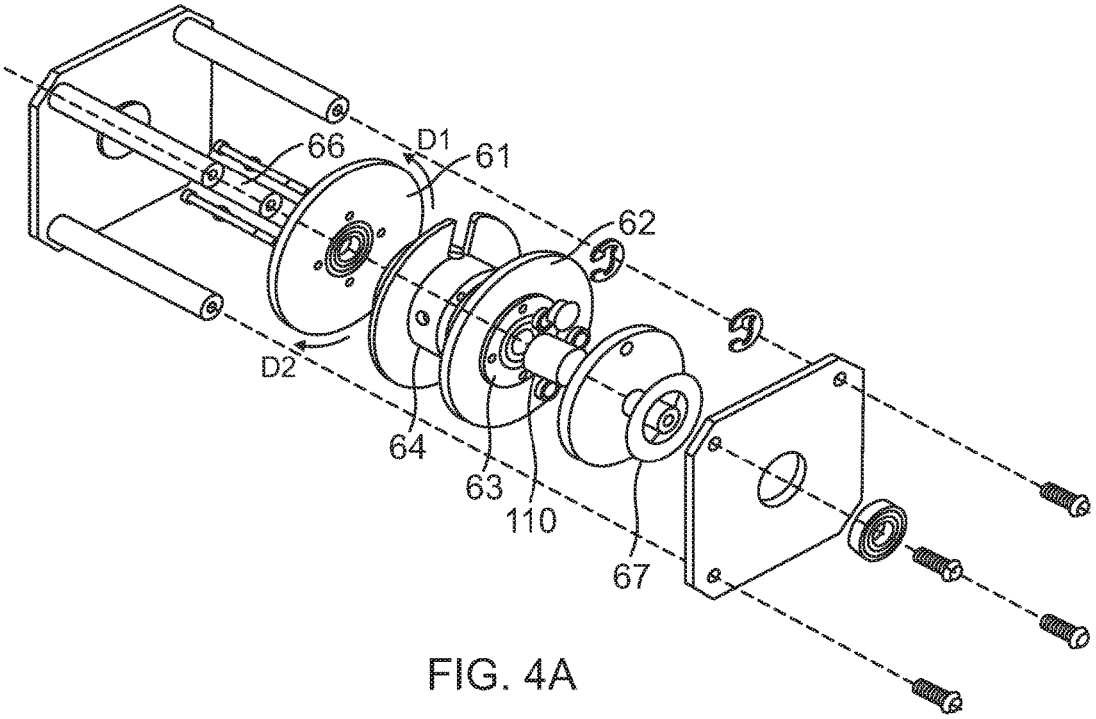
FIG. 4A is a partial perspective exploded view of the winding assembly, cables of the winding assembly omitted for clarity of illustration.
Figure 4B:
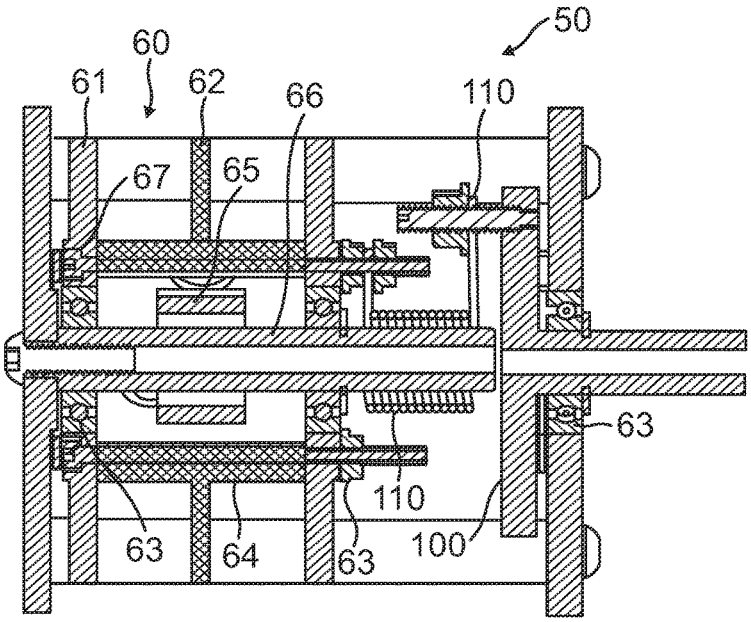
FIG. 4B is a cross-sectional view of the winding assembly of the invention taken along the vertical plane through a rotational axis of a winding assembly and motor.

A winding assembly 50 (FIGS. 4A and 4B) of the exercise device is rotationally captured within the internal space 39 of the enclosure 30 and includes a winding spool 60 configured for receiving a proximal end 72 of at least one cable 70 wound there around in a first rotational direction D1 (FIG. 4A) under the urging of a coil spring 65 that has preferably a substantially constant winding spring tension. The winding spool 60 rotates in an opposite, second direction D2 when a distal end 78 (see FIG. 5) of the at least one cable 70 is pulled away from the winding spool 60 with sufficient force to overcome the winding spring tension, such as when pulled by the person 20 while performing exercises.

A motor 80 (FIG. 3) is preferably included that has a rotational shaft 85 fixed with a threaded screw shaft 90. A rotor plate 100 is fixed with the screw shaft 90 such that rotation of the motor 80 moves the rotor plate 100 either towards or way from the winding spool 60. A torsion spring 110 is fixed between the rotor plate 100 and the winding spool 60 such that rotating the rotor plate causes the torsion spring 110 to increase or decrease a cable unwind resistance 120, inhibiting or assisting, respectively, the unwinding of the at least one cable 70 from the winding spool 60. Alternately a manual knob (not shown) replaces the motor 80, wherein the person 20 can manually adjust the rotation of the rotor plate 100. Preferably, the motor 80, threaded shaft 90, rotor plate 100, coil spring 65 and the winding spool 60 are all mutually coaxially aligned along a common longitudinal axis.

A controller circuit 130 is fixed at least partially within the enclosure 30 and is electrically connected with at least a power source 140, a user interface 150, and the motor 80. The power source 140 is preferably one of a plurality of separately rechargeable battery packs 142 such as are used with battery-operated power tools, or the like. Alternately the power source 140 may be a power cord plugged into a wall outlet or an AC adapter, or the like. The user interface 150 includes an input 160 for changing the cable unwind resistance 120 (FIGS. 2 and 5A).

As such, to perform the exercises, with the enclosure 30 fixed to the exercise machine 15 at the attachment mechanism 40, the person 20 sets the desired cable unwind resistance 120 with the user interface 150 and then pulls the at least one cable 70 to unwind the at least one cable 70 from the winding spool 60. The winding spring tension of the coil spring 65 thereafter rewinds the at least one cable 70 onto the winding spool 60 when the person releases tension on the at least one cable 70, preferably with enough tension that the at least one cable 70 does not droop when retracting, and instead retracts completely and at a brisk pace. Either individually or in combination, the coil spring 65 and the torsion spring 110 accomplish this return resistance. The person 20 then pulls the at least one cable 70 again to repeat the process.

Preferably, the distal end 78 of the at least one cable 70 is fixed with a grip element 170, such as an exercise bar 171 (FIG. 5A), to facilitate the person 20 pulling the at least one cable 70. Such an exercise bar 171 preferably has two opposing ends 172 each covered with a grip material 173. The at least one cable 70 is fixed with the exercise bar 171 through the use of suitable rigid connectors such as D-rings, Carabineers, or similar connectors. Alternately, as illustrated in FIGS. 1 and 2, the exercise device 10 can have two of the cables 70 each terminating at a handle 174. In some embodiments the grip element 170 may be a foot strap (not shown) for conducting foot and/or leg exercises. Likewise, the grip element 170 may be a torso strap (not shown) for conducting core muscle group exercises, such as ab exercises, or the like.

Preferably, the winding spool 60 further includes a first circular flange 61 and a second circular flange 62 (FIGS. 4A & 4B), each having a rotational bearing 63 and coupled to a spool base ring 64 that is fixed with the coil spring 65. As such, the coil spring 65 retracts the at least one cable 70 onto the spool 60 in the first direction D1 when tension on the at least one cable 70 is released and when tension on the torsion spring 110 is released. Conversely, when the at least one cable 70 is pulled by the person 20, the spool 60 spins in the second direction D2. The spool base ring 64 and the first and second circular flanges 61, 62 are preferably mounted on an axle 66, the coil spring 65 being fastened between the spool base ring 64 and the axle 65.

In one embodiment, not illustrated, the spool base ring 64 is rotationally coupled to the first and second circular flanges 61, 62 with a ratchet mechanism for retracting the at least one cable 70 onto the base ring 64 under tension from the coil spring 65, but without rotating the first and second circular flanges 61, 62. When the at least one cable 70 is pulled by the person 20, the ratchet mechanism locks the spool base ring 64 to the first and second circular flanges 61, 62, and thus the tension of the torsion spring 110 against the second circular flange 62 is transmitted to the person 20 as increased resistance for performing the exercise.

Figure 5B:
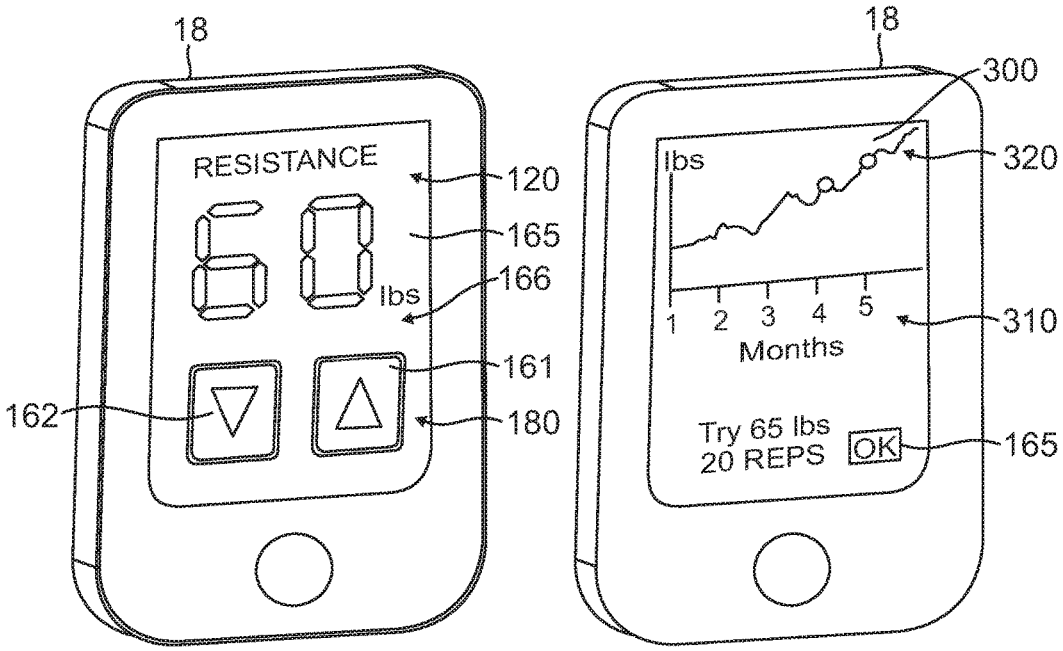
FIG. 5B is a front view of a second smartphone interface showing the user's exercise history and goal information.

The user interface 150 of the controller circuit 130 preferably includes at least a switch 161 for increasing cable unwind resistance 120 and a switch 162 for decreasing cable unwind resistance 120 (FIGS. 2 and 5A). Such switches 161, 162 may be soft switches 166 displayed on a touch-screen by a software application 180 running on the controller circuit 130, at least one wireless remote 200, a smartphone 18, or the like. In some embodiments the controller circuit 130 includes a wireless transceiver 190 to communicate with the at least one wireless remote 200 or the smartphone 18 through the use of commonly-used wireless protocols such as BLUETOOTH®, WIFI®, or the like (FIGS. 5A, 5B).

Preferably, such a wireless remote 200 is fixed proximate the distal end 78 of the at least one cable 70, such that the person 20 has ready access to the switches 161, 162. For example, the at least one wireless remote 200 may be incorporated into the handles 174 (FIG. 2) so that while the person 20 is exercising he may increase or decrease the cable unwind resistance 120 without interrupting the exercise.

In some embodiments the motor 80 is a stepper motor, and the controller circuit 130 includes the wireless transceiver 190 and is configured for reporting to the software application 180 on the smartphone 18 a current position value of the stepper motor 80. As such, the software application 180 is configured to convert the current position value of the stepper motor 80 into a cable unwind resistance 120 value or setting for tracking the person's exercise progress 300 over time and for suggesting cable unwind resistance settings 310 over time to achieve a preset exercise goal 320 of the person 20 (FIGS. 5A & 5B). Such an unwind resistance setting 310 may be converted into an estimated weight in pounds equivalent measurement by the software application 180. In such an embodiment, an environment full of different exercise machines 15 may each include one of the exercise devices 10 with a different ID number, the software application 180 configured for reading the plurality of the exercise devices 10 on various exercise machines 15 to track the person's exercising history and goals on each exercise machine 15 separately.

Figure 6:
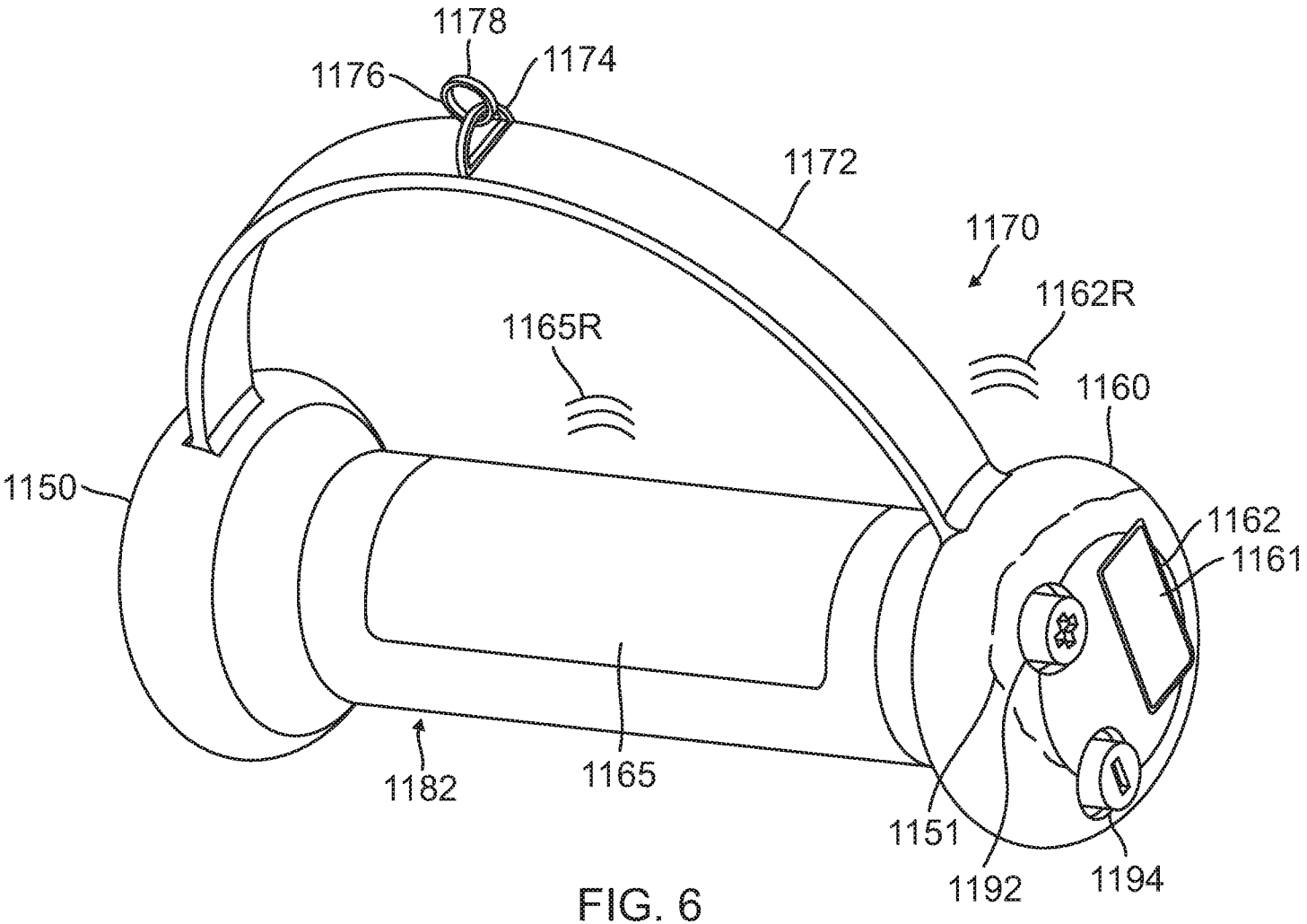
FIG. 6 is a revised grip element having a display screen, an increase tension control button and a decrease tension control button.

Referring to FIG. 6, there is illustrated an improved grip element 1170 having a first ellipsoidal-shaped end 1150 at a first end connected via a cylindrical gripping member 1182 to a second ellipsoidal-shaped end 1160. A gripping sensor 1165 rests on the gripping member 1182. In this way, when a gripping force is applied to the gripping sensor 1165, this generates a communication through radio frequency 1165R to electronic command circuit board 1130 to cause the motor 1080 to activate and turn on, thereby creating resistance. When the hand releases the grip on the gripping member 1182, this creates a decompression of the force on the gripping sensor 1165 which generates a communication through radio frequency to the electronic command circuit board 1130 to cause the motor 1080 to turn off. When the user lets go of the handle and releases gripping sensor 1165, the cables are retracted to the original position and the motor will deactivate. If the user abruptly lets the handles go before allowing the handles to return to their original position, the motor will decrease tension immediately and the cables will retract more slowly. For example, if the user has loaded 100 lbs on the device and lets the grip element 1170 go while the cables are extended, it will not cause the grip element 1170 to crash back into the assembly because the power is immediately reduced to a safe load as soon as the grip is released.

Second ellipsoidal-shaped end 1160 has a display screen 1162 with a readable surface 1161 adjacent a plus or increase tension button 1192 and a minus or decrease tension button 1194. A semicircular support arm 1172 also connects first ellipsoidal-shaped end 1150 to second ellipsoidal-shaped end 1160. Semicircular support arm 1172 also has a semicircular-shaped connection member 1174 that connects to a ring 1176. Ring 1176 has an opening 1178 to allow one end of cable 70 to attach to or be tied to ring 1176. It should also be understood that there is a circuit board 1151 illustrated in dashed lines located in second ellipsoidal-shaped end 1160 that contains either a transmitter and/or a receiver or a transceiver to communicate with electronic command circuit board 1130 (illustrated in FIGS. 8B, 8C and 8D). This communication is by radio frequency (RF) 1162R signal and allows the user to adjust the tension on cable 70.

Figure 7:
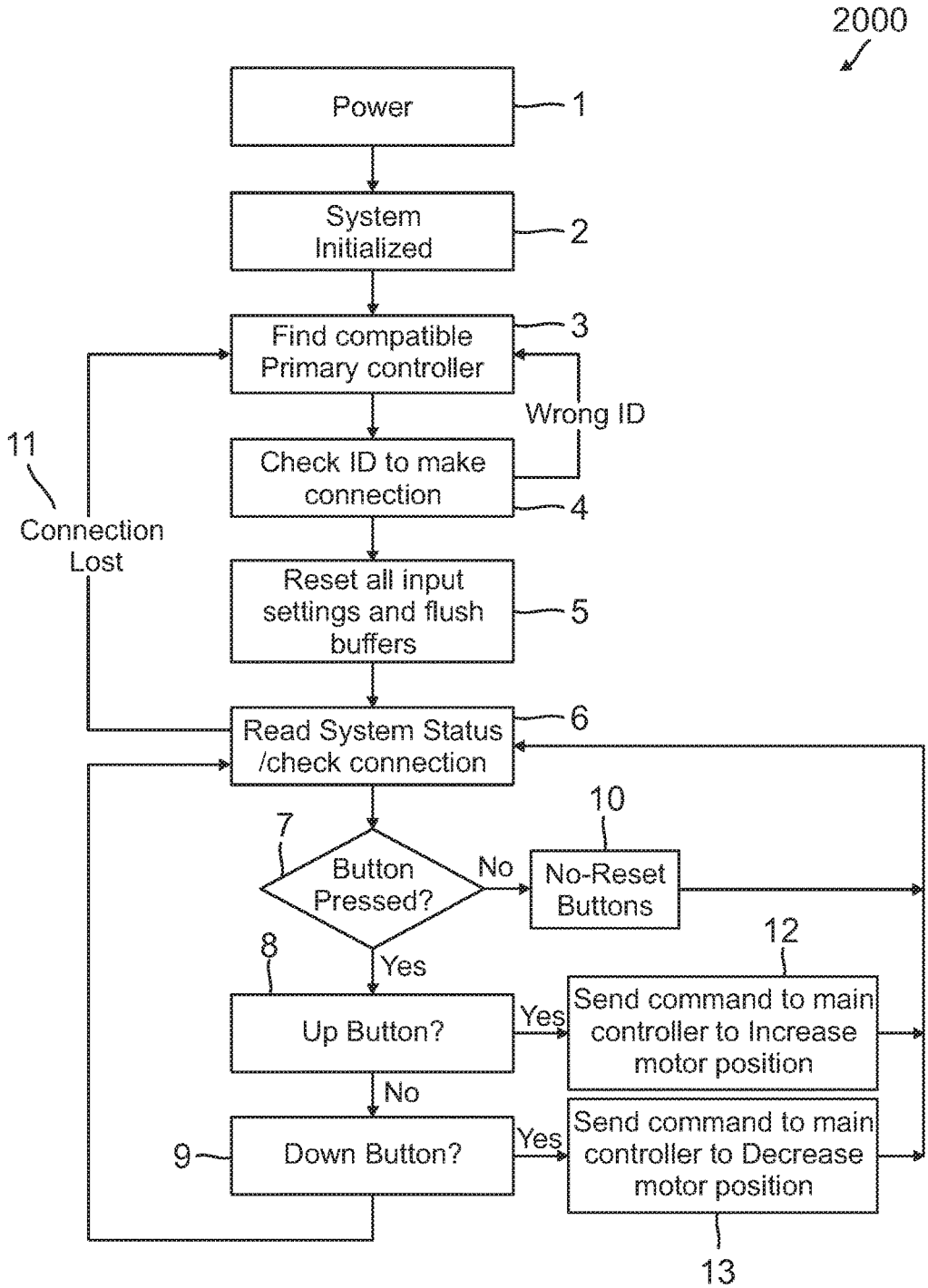
FIG. 7 is a flowchart that illustrates the communication between the grip element and the exercise device.

Referring to FIG. 7, there is illustrated a logic flowchart 2000 that details the communication between the improved grip element 1170 and the improved exercise device 1010. FIG. 7 is a logic flow chart to explain the electrical steps in the logic flow diagram. There are no part numbers. Instead, the steps are numbered in the flow chart boxes. The number 10A is used because the number 10 has been previously assigned to a part number. During operation, the sequence of steps is as follows with the numbers presented in the order the steps appear in the logic flow chart of FIG. 7:

1. The system is powered on;
2. The main electronic circuit board is located and the handle initialized;
3. The handle looks for compatible master electronic circuit board and keeps searching until it finds the master electronic circuit board;
4. Once found, confirms device IDs and connects;
5. Once connected, the devices reset and set to an initial predefined starting point;
6. Both devices continually checking the input buttons and rechecking connection with master electronic circuit board;
7. ON button pressed on the handle, device identifies which button was pressed and sends command to master electronic circuit board;
8. If UP button depressed, signal to move the motor to increase the resistance. Returns to step 6 after command set;
9. If DOWN button depressed, signal to move the motor to decrease the resistance. Returns to step 6 after command set;
10. If neither button confirmed, return to step 6;
11. If connection between the handle and the master electronic circuit board is lost, the handle device resets and returns to step 2; and
12. If the handle is powered down, the master electronic circuit board will continue to function as the previous established settings by controller via the touch screen interface.

Figure 8A:
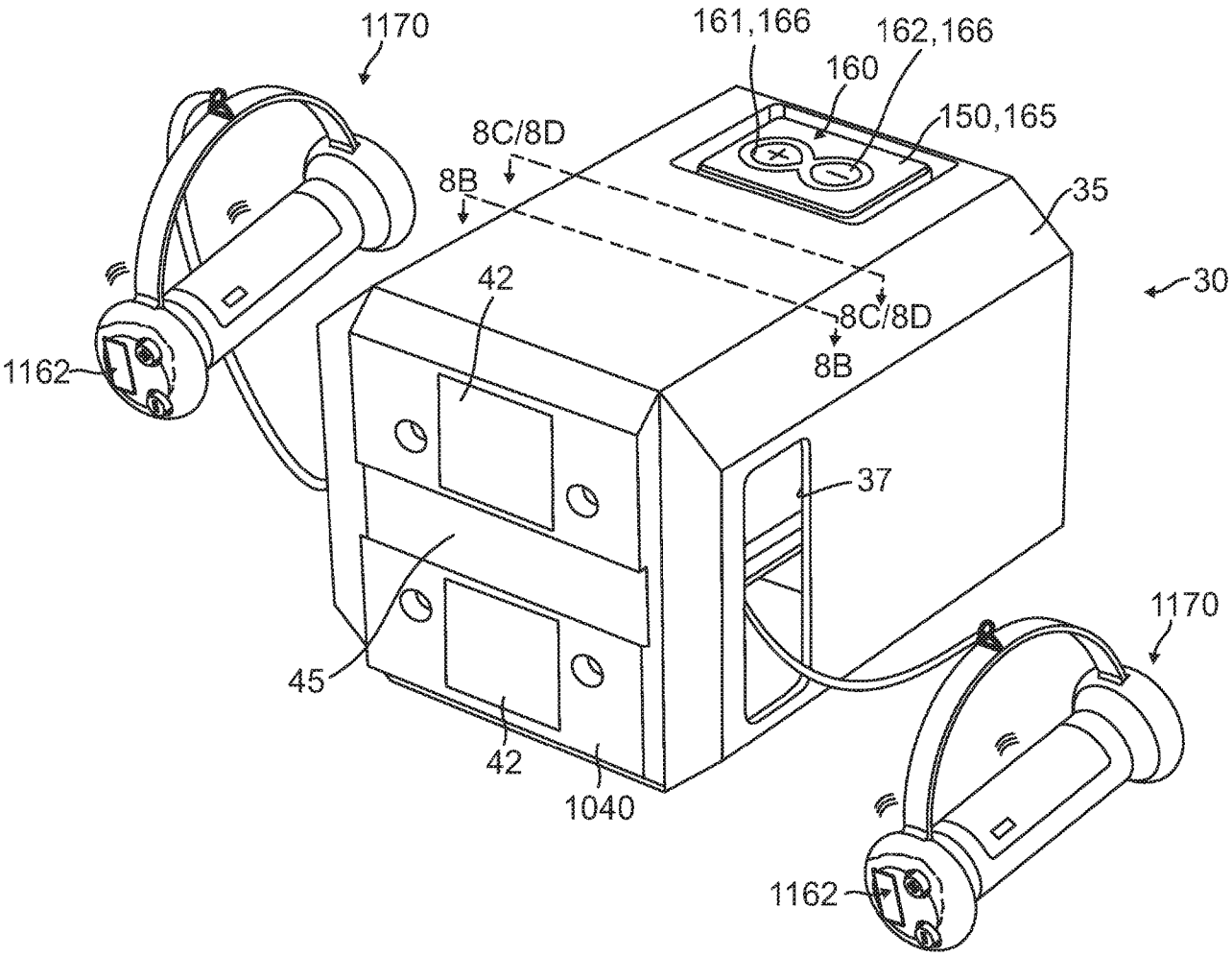
FIG. 8A is a perspective view of the rigid enclosure of the present invention illustrating the handles with pushbuttons extending out of the rigid enclosure with the elements inside the rigid enclosure depicted in the subsequent cross-sectional views of FIG. 8, 8C and 8D.

Referring to FIG. 8A, there is illustrated a perspective view of the present invention enclosed rigid enclosure which contains the operational members of the present invention with the exception of the handles which extend outside the enclosure as illustrated in FIG. 8A. The handles 1170 have already been previously described. The user interface 150 of the master command controller circuit 1130 preferably includes at least a switch 161 for increasing cable unwind resistance and a switch 162 for decreasing cable unwind resistance (FIG. 8A). Such switches 161, 162 may be soft switches 166 displayed on a touch-screen by a software application running on the master command controller circuit 1130, at least one wireless remote or a smartphone or the like. In some embodiments the controller circuit 1130 includes a wireless transceiver to communicate with the at least one wireless remote or the smartphone through the use of commonly-used wireless protocols.

Figure 8B:
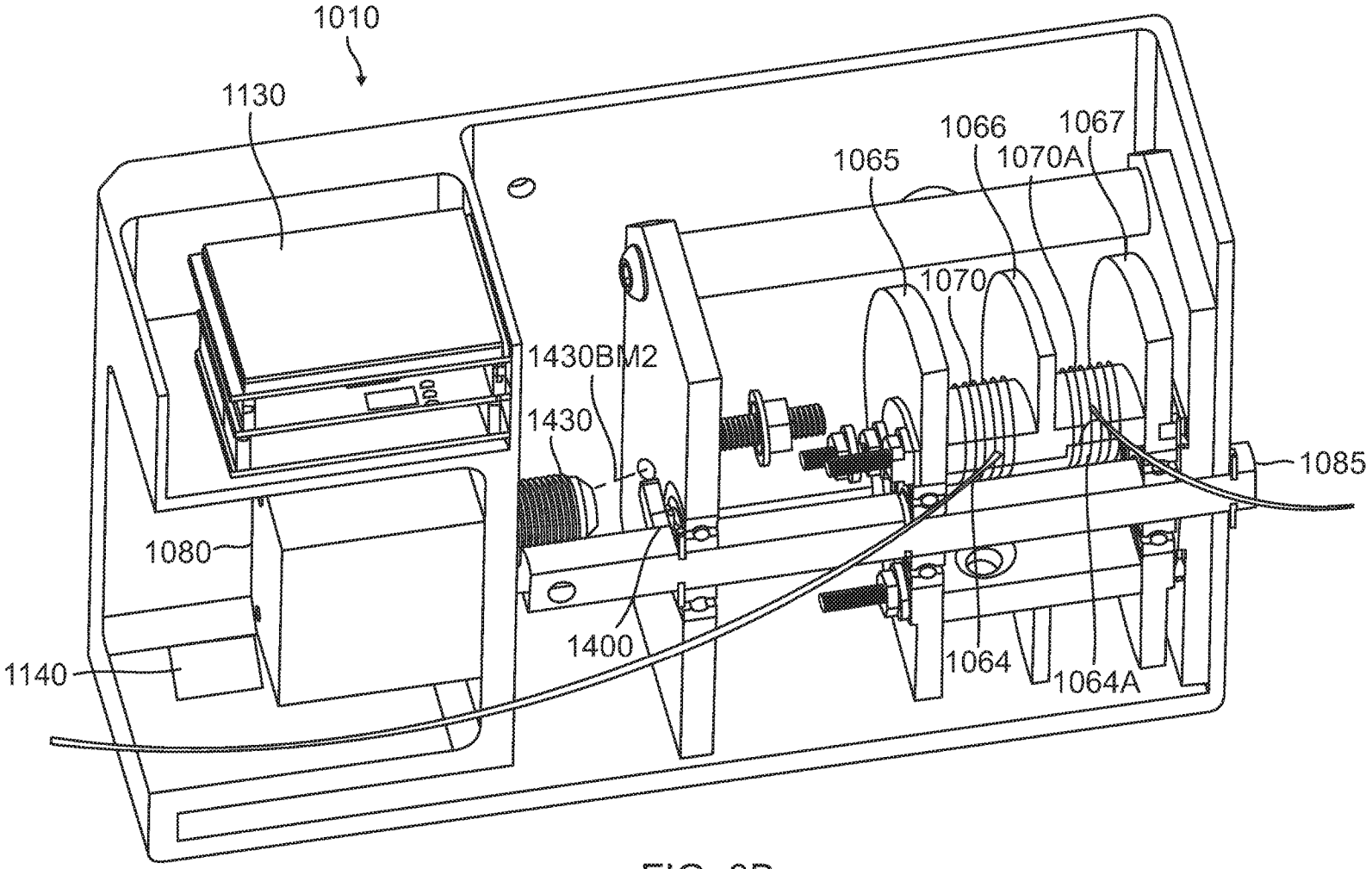
FIG. 8B is a cross-sectional view taken along line 8B-8B of FIG. 8A.

Referring to FIG. 8B, there is illustrated a cross-sectional view improved exercise device 1010 taken along line 8B-8B of FIG. 8A. The improved exercise device 1010 illustrated in FIG. 8B functions in an improved way over the previously disclosed apparatus using a torsion spring for resistance. The spring 65 (disclosed in FIG. 3) is replaced by sensors. The sensors, electronic command circuit board 1130 and motor 1080 perform the resistance as an anti-rotational device to create tension for cables 1070 and 1070A during use. Optionally, the motor 1080 can include a gear reduction to modify output torque.

An electronic command circuit board 1130 is fixed at least partially within the enclosure 1010 and is electrically connected with at least a power source 1140, a user interface 150, and the motor 1080. The power source 1140 is preferably one of a plurality of separately rechargeable battery packs such as are used with battery-operated power tools, or the like. Alternately the power source 1140 may be a power cord plugged into a wall outlet or an AC adapter, or the like. The user interface 150 includes an input 160 for changing the cable unwind resistance (FIG. 8A).

As such, to perform the exercises, with the enclosure 1-100 fixed to an exercise machine at the attachment mechanism 1040, the person sets the desired cable unwind resistance with the user interface 150 and then pulls the at least one cable 1070 or 1070A to unwind the at least one cable 1070 or 1070A from a respective spool 1064 or 1064A. There is a sensor target 1400 that is connected to shaft 1085 on a first side and adjacent proximity sensor 1430 on a second side. The proximity sensor 1430 has a direct line of sight to sensor target 1400 with a beam 1430BM1. When the sensor target 1400 is stationary, the beam 1430BM1 has constant visual contact with sensor target 1400. When the sensor target 1400 moves, the beam 1430BM1 moves out of the line of sight of the proximity sensor 1430 and it is then that the proximity sensor 1430 is triggered to activate the electronic command circuit board 1130. There are two cables 1070 and 1070A wrapped around respective spools 1064 and 1064A separated by the flanges. Flanges 1065 and 1066 are on opposite sides of spool 1064 and flanges 1066 and 1067 are on opposite sides of spool 1070A. Flange 1066 separates spools 1070 and 1070A. As cable 1070 or 1070A is pulled for exercise, or respectively unwound from spool 1064 or 1064A, the sensor target 1400 rotates and the movement/rotation of the sensor target 1400 so that the beam 1430BM1 moves out of the line of sight of the proximity sensor 1430 and this advises the proximity sensor that there is rotation of the shaft which causes the proximity sensor to transmit the signal to the electronic command circuit board 1130 to activate the motor 1080 to increase resistance. The sensor target is offset from the shaft 1085 and comes into view and out of view as the shaft 1085 rotates. The amount of resistance is set by the preset resistance either by the buttons 1192 and 1194 or on the touch screen 42 illustrated in FIG. 8A and described with reference to FIG. 2. Optionally, the motor 1080 can include a gear reduction to modify output torque.

Figure 8C:
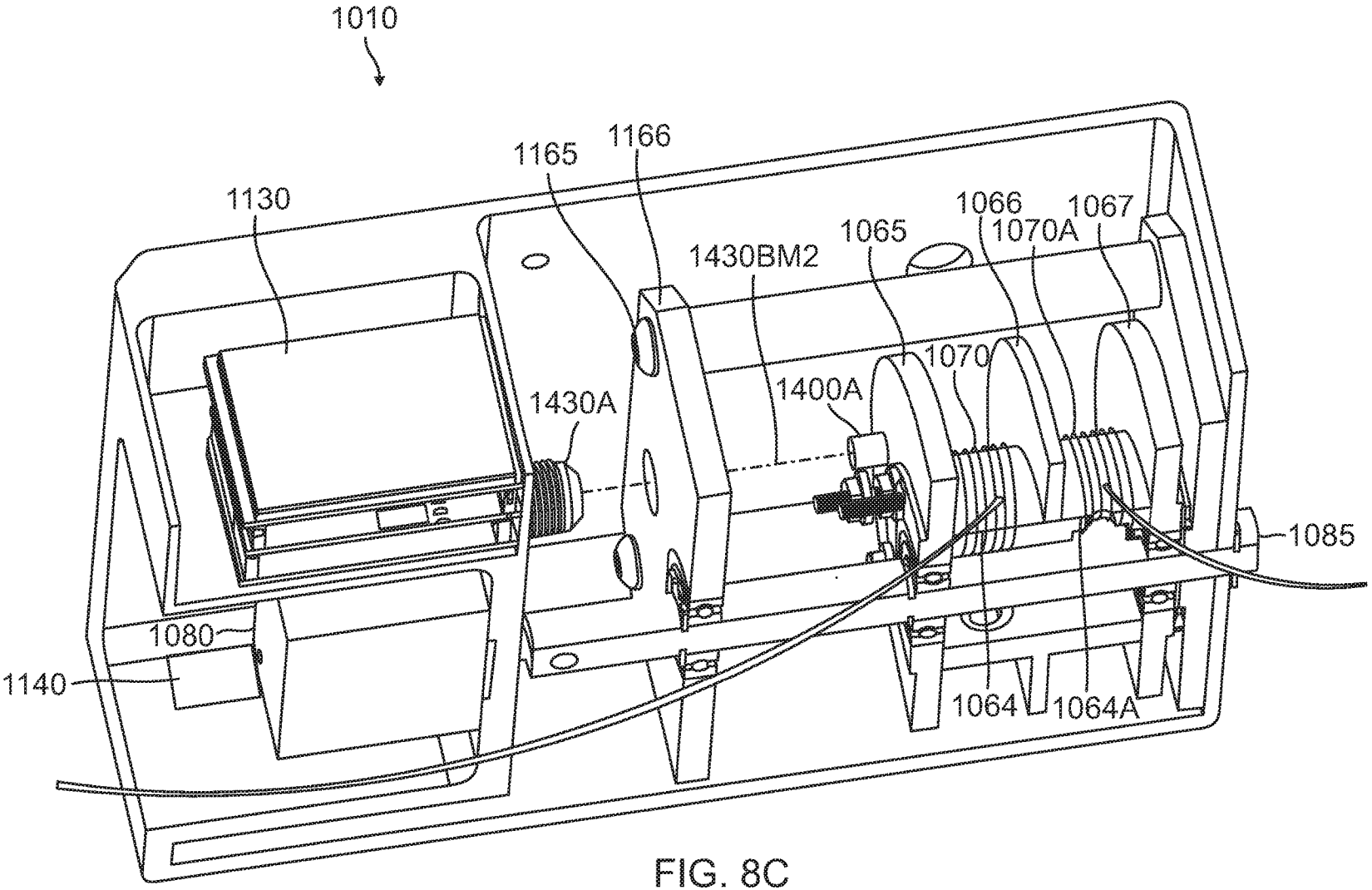
FIG. 8C is a cross-sectional view taken along line 8C-8C/8D-8D of FIG. 8A and illustrates a beam from the proximity sensor to a sensor target on a flange.

Alternatively, referring to FIG. 8C, there is a sensor target 1400A that is connected to flange 1065 and an opening 1163 in wall 1166 provides a visual contact with proximity sensor 1430A through beam 1430BM2. The proximity sensor 1430A has been moved from its position in FIG. 8B and has a direct line of sight beam 1430BM2 to sensor target 1400A. There are two cables 1070 and 1070A wrapped around respective spools 1064 and 1064A separated by flanges. Flanges 1065 and 1066 are on opposite sides of spool 1064 and flanges 1066 and 1067 are on opposite sides of spool 1070A. Flange 1066 separates spools 1070 and 1070A. As cable 1070 or 1070A is pulled for exercise, or respectively unwound from spool 1064 or 1064A, the sensor target 1400A rotates with the flange 1065 and the movement/rotation of the sensor target 1400A where the proximity sensor 1430A sees that beam 1430BM2 no longer is in visual contact with the sensor target 1400A and the sensor target 1400A has moved out of the beam location so that the motion of the sensor target is received by the proximity sensor 1430A which transmits the signal to the electronic command circuit board 1130 to activate the motor 1080 to increase resistance. The amount of resistance is set by the preset resistance either by the buttons 1192 and 1194 or on the touch screen 42 illustrated in FIG. 8A and described with reference to FIG. 2.

Further described, the initial position is defined as the position in which the system is at rest, the cable assembly has a fully wound cable, the handles are not in use, and the motor is not active. Once the user pulls the handles away for use, the sensor target rotates away from the line of sight of the sensor. This triggers the sensor to communicate with the electric command circuit board 1130 to activate the motor 1080 and create resistance in the cable assembly. In order to shut off the motor 1080, there is a time delay for the sensor to read the location of the sensor target, so that as the cable assembly rotates, the sensor target needs to be within line of sight of the sensor target for a preset amount of time before the sensor target recognizes that it is to shut off power to the motor.

In summary, this is how the proximity sensor and sensor target work. The proximity sensor is located adjacent to the drive motor. A sensor target is located on the shaft, or rotating flange, or any part of the system that rotates with the cable assembly. In its initial position, the sensor target is in the line of sight of the proximity sensor. The initial position is determined as the position in which the system is at rest. The cable assembly has a fully rewound cable, the handles are not in use, and the motor is not activated. Once the user pulls the handles away from its spool, the sensor target rotates away from the line of sight of the proximity sensor. This triggers the proximity sensor to send a signal to the electronic command circuit board which in turn activates the motor which creates resistance in the cable assembly. After the exercise is completed and the cables are released back to their normal position, the sensor target stops moving and goes back to the line of sight of the proximity sensor. There is a time delay for the sensor to read the location of the sensor target to determine that the cable assembly is not rotating. The sensor target needs to be within the line of site of the proximity sensor for a preset amount of time before the proximity sensor recognizes that the rotation of the sensor target has terminated and sends a signal to the electronic circuit board to shut off the motor.

Figure 8D:
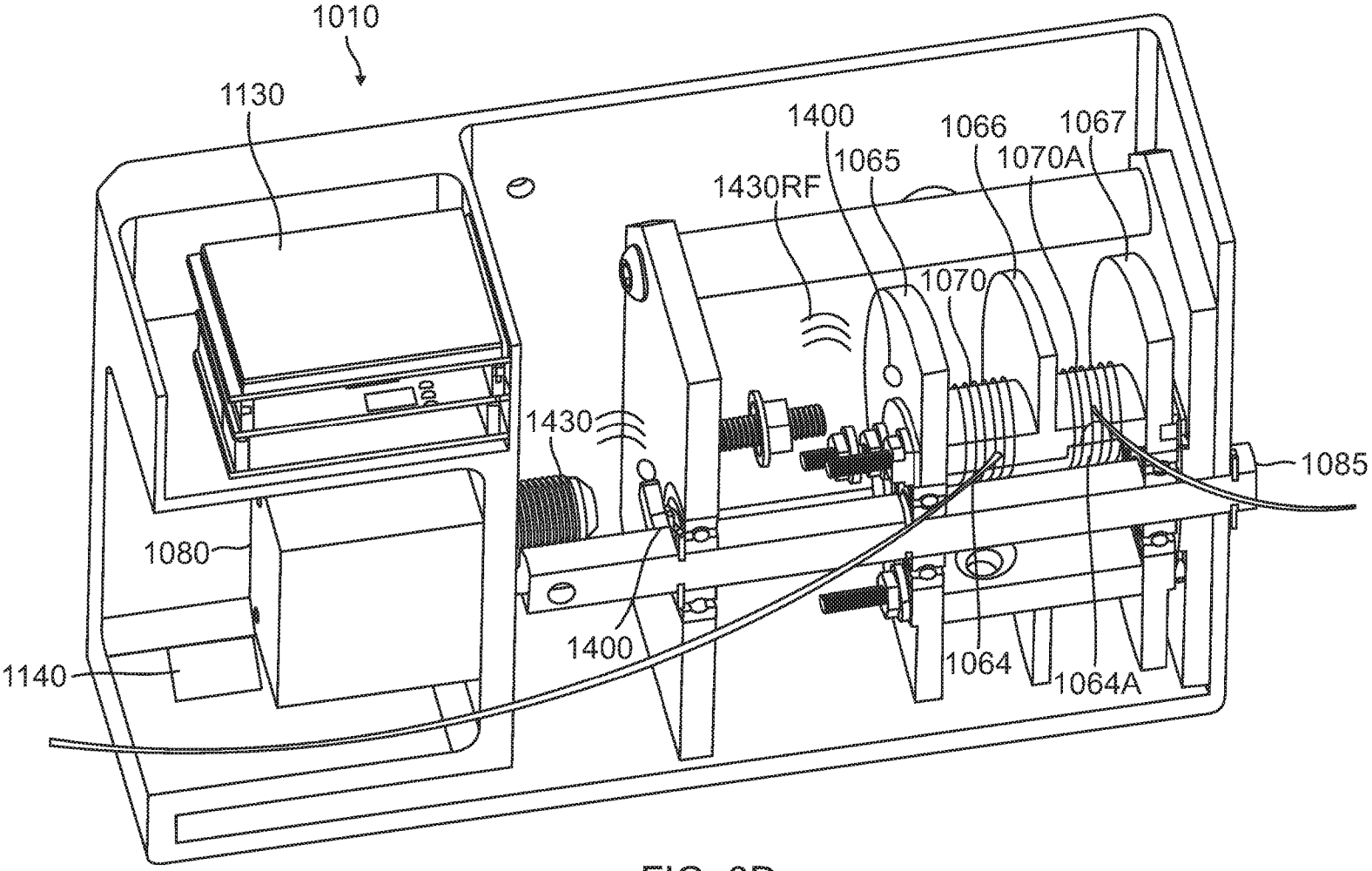
FIG. 8D is a cross-sectional view taken along line 8C-8C/8D-8D of FIG. 8A and illustrates radio frequency transmission between sensor targets anywhere on the shaft or flange and the proximity sensor.

The communication between proximity sensor 1430 and sensor target 1400 can be line of sight communication or by radio frequency. Referring to FIG. 8D, there is illustrated the radio frequency signal communication between the sensor target and the proximity sensor. Therefore, it is within the spirit and scope of this invention for the location of the sensor target and the proximity sensor to be anywhere within the rigid enclosure as long as the sensor target 1400 is on a part that rotates, either the shaft 1085 or at least one of the flanges 1065, 1066, or 1067, which movement occurs as the cables 1070 and 11070 are pulled during exercise when communication between proximity sensor 1430 and sensor target 1400 is by radio frequency 1430RF. Optionally, the motor 1080 can include a gear reduction to modify output torque.

Figure 9:
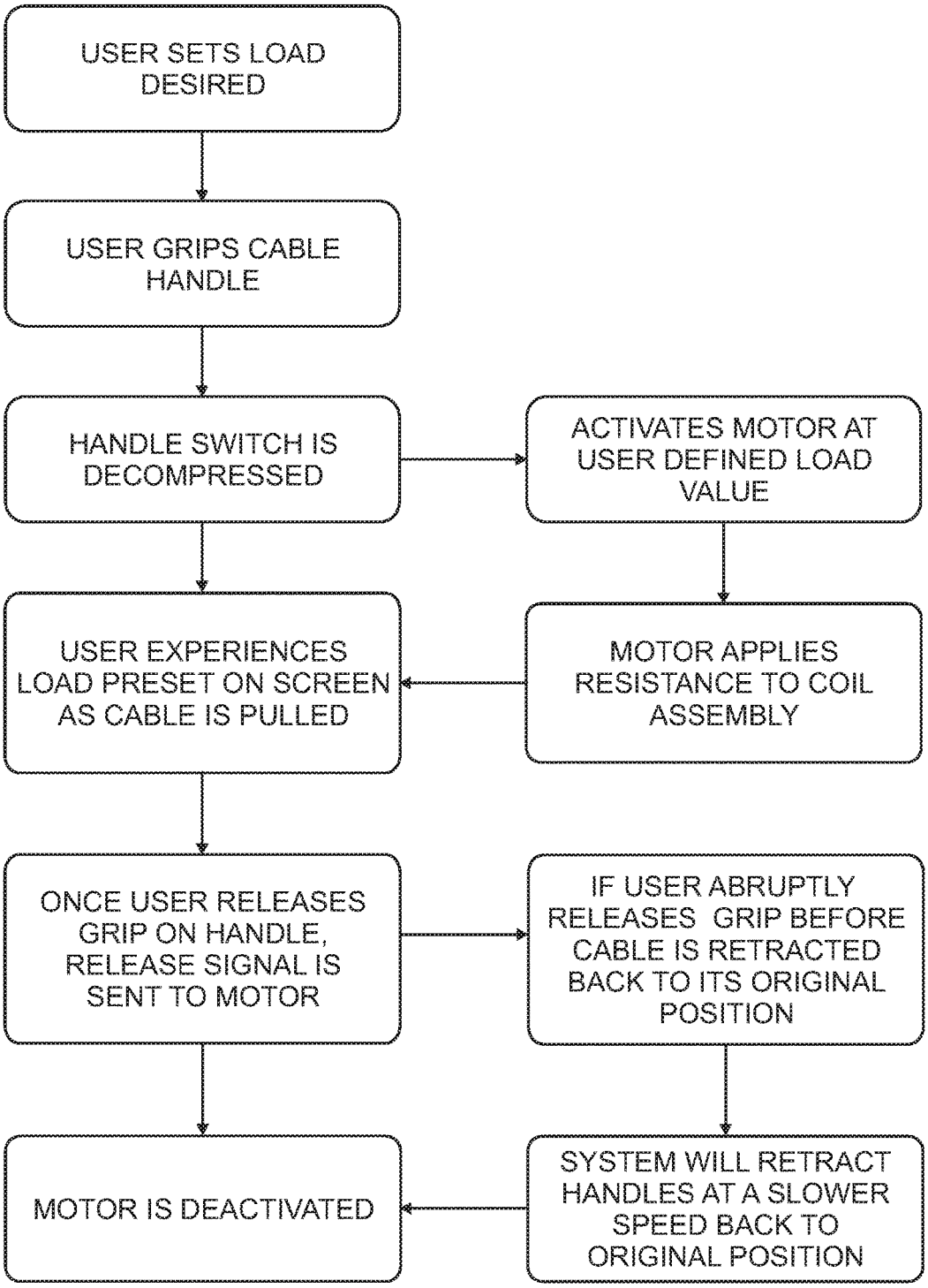
FIG. 9 is a flowchart that illustrates the function of the present invention exercise device utilizing sensors in place of springs.

Referring to FIG. 9, there is illustrated a flowchart that describes the function of the present invention exercise device 1010 utilizing sensors communicating with a motor. The flow chart does not contain numbers and is a logic flow chart to describe grip handle functions.

The workflow of the present invention is as follows:

(1) at a first initial condition, the user sets a desired load;
(2) the user grips the cable handles;
(3) the handle switch is decompressed—this activates the motor at user defined load value;
(4) the user experiences preset on screen as cable is pulled motor applies resistance to assembly;
(5) once user releases grip on handle, release signal is sent to the motor—if the user abruptly releases the grip before cable is retracted back to its original position then the system will retract handles at a slower speed back to original position;
(6) if handle is released, the motor is deactivated.

Figure 10:
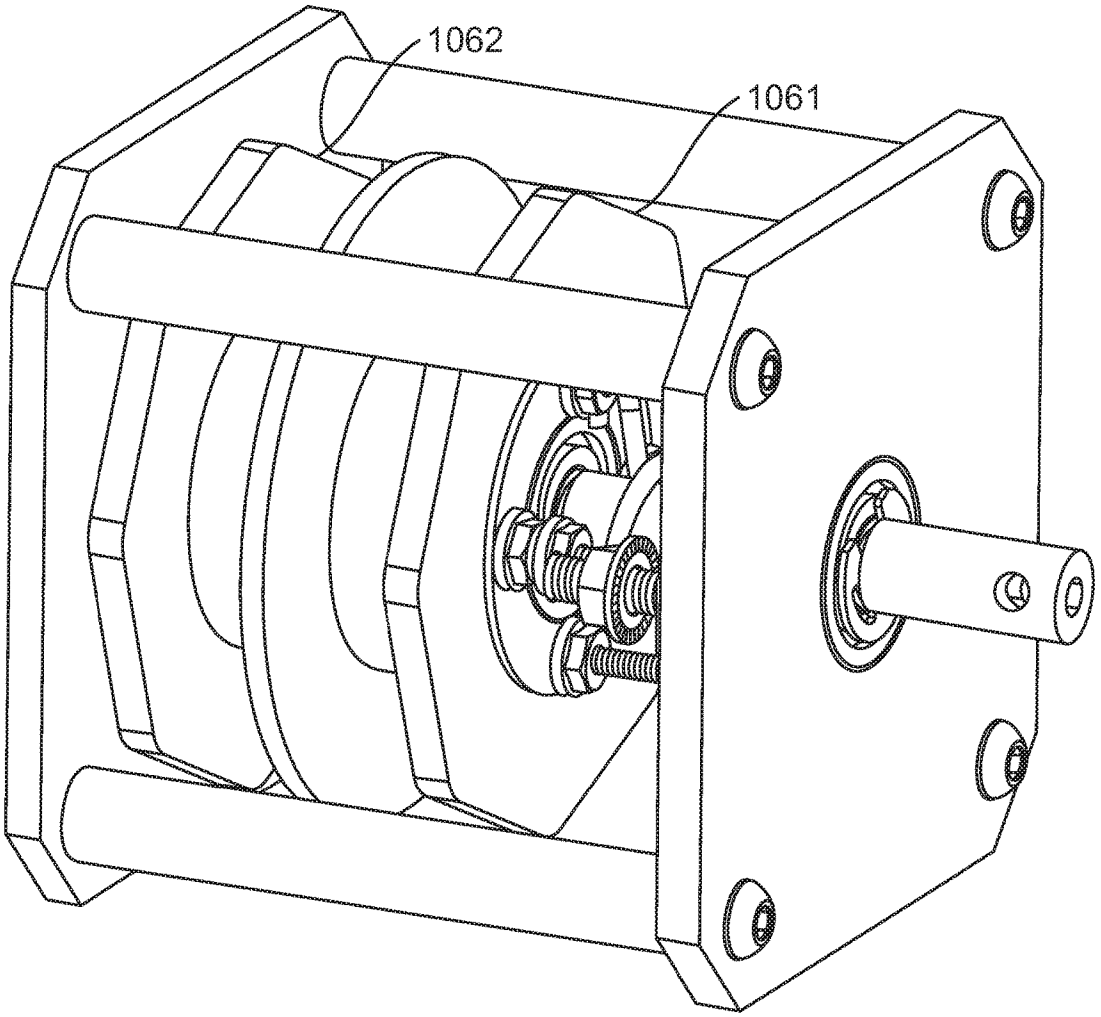
FIG. 10 is a view of the improved internal winding assembly illustrating non-circular flanges.

Referring to FIG. 10, there is illustrated a view of the internal winding assembly illustrating non-circular flanges 1061 and 1062. It is within the spirit and scope of this improved exercise device 1010 for the shape of the flanges that are located on the outside and assist in enclosing cable 1070 within the winding spool to be of any polygonal shape including, but not limited to, triangular, rectangular, pentagonal, hexagonal, octagonal or other commonly known non-circular shapes.

Figure 11:
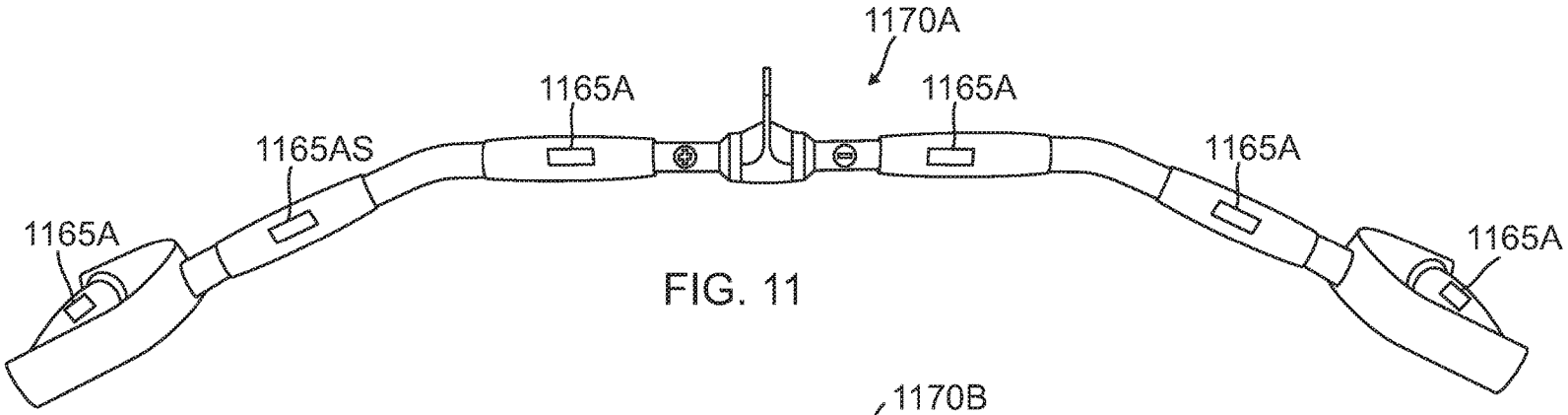
FIG. 11 is a perspective view of a lat bar including gripping sensors, plus/minus load variation buttons, and a display screen with readable surface.

Referring to FIG. 11, there is illustrated a perspective view of a variation of a lat bar 1170A with gripping sensors 1165A, plus/minus buttons for increasing and decreasing resistance, and a display screen with readable surface 1165AS.

Figure 12:
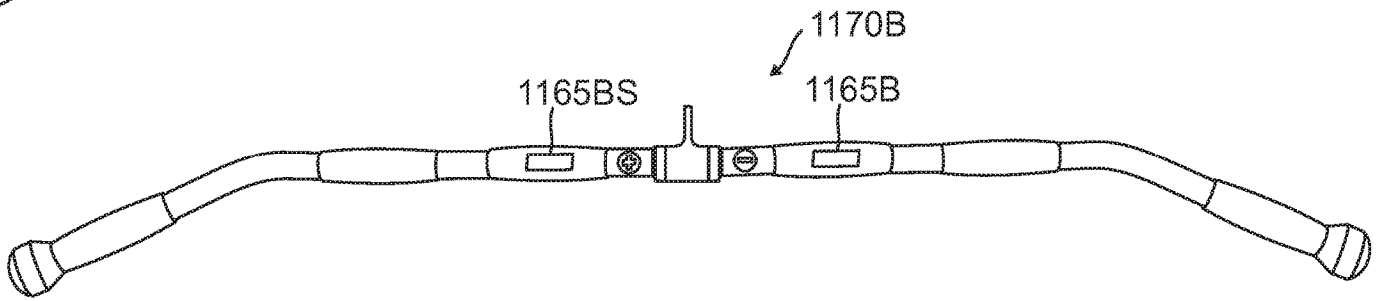
FIG. 12 is a perspective view of a variation of a lat bar including gripping sensors, plus/minus load variation buttons, and a display screen with readable surface.

Referring to FIG. 12, there is illustrated a perspective view of a variation of the lat bar 1170B with gripping sensors 1165B, plus/minus buttons for increasing and decreasing resistance, and a display screen with readable surface 1165BS.

Figure 13:
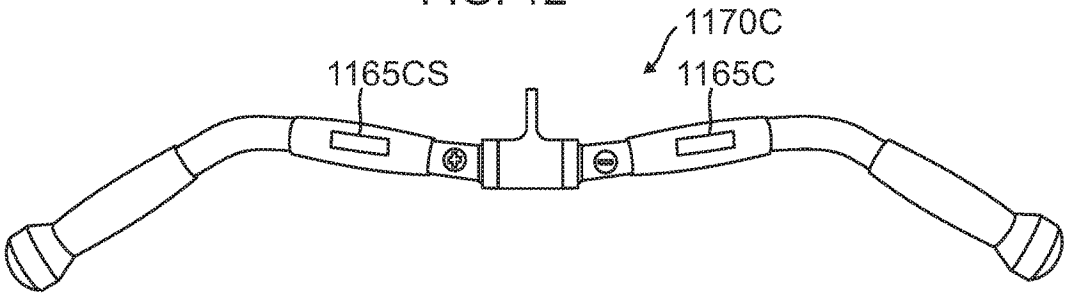
FIG. 13 is a perspective view of a curl bar including gripping sensors, plus/minus load variation buttons, and a display screen with readable surface.

Referring to FIG. 13, there is illustrated a perspective view of a curl bar 1170C with gripping sensors 1165C, plus/minus buttons for increasing and decreasing resistance, and a display screen with readable surface 1165CS.

Figure 14:
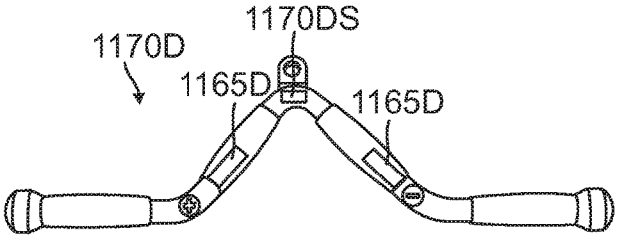
FIG. 14 is a perspective view of a narrow grip lat bar including gripping sensors, plus/minus load variation buttons, and a display screen with readable surface.

Referring to FIG. 14, there is illustrated a perspective view of a narrow grip lat bar 1170D with gripping sensors 1165D, plus/minus buttons for increasing and decreasing resistance, and a display screen with readable surface 1170DS.

Figure 15:
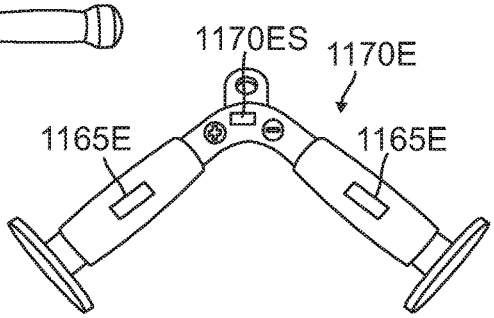
FIG. 15 is a perspective view of one variation of a V-bar including gripping sensors, plus/minus load variation buttons, and a display screen with readable surface.

Referring to FIG. 15, there is illustrated a perspective view of a variation of a V-bar 1170E with gripping sensors 1165E, plus/minus buttons for increasing and decreasing resistance, and a display screen with readable surface 1170ES.

Figure 16:
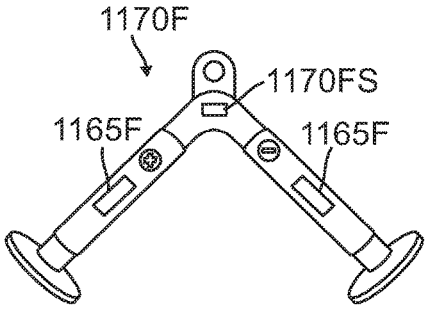
FIG. 16 is a perspective view of a second variation of a V-bar including gripping sensors, plus/minus load variation buttons, and a display screen with readable surface.

Referring to FIG. 16, there is illustrated a perspective view of a V-bar 1170F with gripping sensors 1165F, plus/minus buttons for increasing and decreasing resistance, and a display screen with readable surface 1170S.

Figure 17:
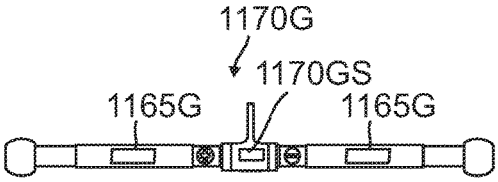
FIG. 17 is a perspective view of a straight bar including gripping sensors, plus/minus load variation buttons, and a display screen with readable surface.

Referring to FIG. 17, there is illustrated a perspective view of a variation of a straight bar 1170G with gripping sensors 1165G, plus/minus buttons for increasing and decreasing resistance, and a display screen with readable surface 1170GS.

Figure 18:
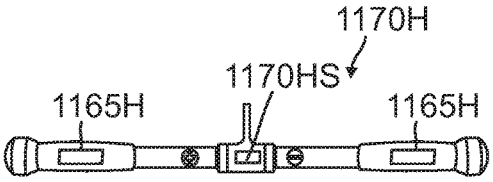
FIG. 18 is a perspective view of another variation of a straight bar including gripping sensors, plus/minus load variation buttons, and a display screen with readable surface.

Referring to FIG. 18, there is illustrated a perspective view of another variation of a straight bar 1170H with gripping sensors 1165H, plus/minus buttons for increasing and decreasing resistance, and a display screen with readable surface 1170HS.

Figure 19:
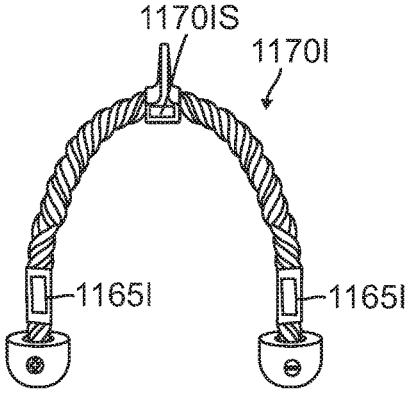
FIG. 19 is a perspective view of a rope including gripping sensors, plus/minus load variation buttons, and a display screen with readable surface.

Referring to FIG. 19, there is illustrated a perspective view of a triceps rope 11701 with gripping sensors 1165I, plus/minus buttons for increasing and decreasing resistance, and a display screen with readable surface 1170IS.

Figure 20:
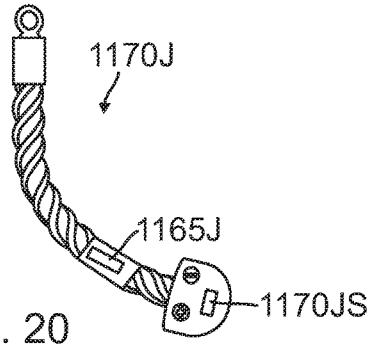
FIG. 20 is a perspective view of a triceps rope including gripping sensors, plus/minus load variation buttons, and a display screen with readable surface.

Referring to FIG. 20, there is illustrated a perspective view of a single triceps rope 1170J with gripping sensors 1165J, plus/minus buttons for increasing and decreasing resistance, and a display screen with readable surface 1170JS.

Figure 21:
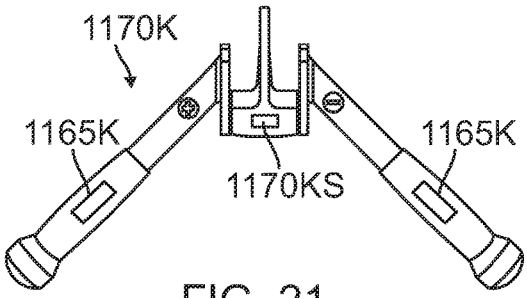
FIG. 21 is a perspective view of another variation of a rope including gripping sensors, plus/minus load variation buttons, and display screen with readable surface.

Referring to FIG. 21, there is illustrated a perspective view of a V-bar 1170K with gripping sensors 1165K, plus/minus buttons for increasing and decreasing resistance, and a display screen with readable surface 1170KS.

Figure 22:
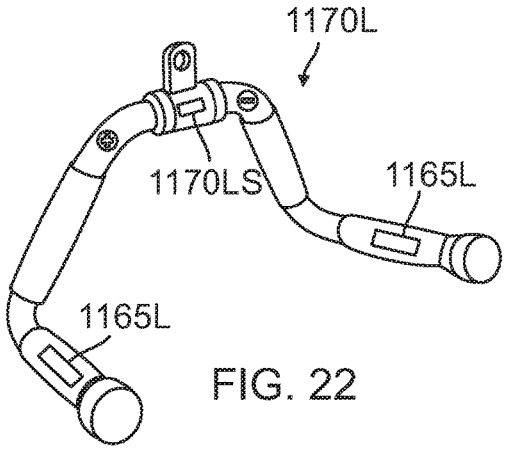
FIG. 22 is a perspective view of a multi-exercise bar including gripping sensors, plus/minus load variation buttons, and a display screen with readable surface.

Referring to FIG. 22, there is illustrated a perspective view of a multi-exercise bar 1170L with gripping sensors 1165L, plus/minus buttons for increasing and decreasing resistance, and a display screen with readable surface 1170LS.

Figure 23:
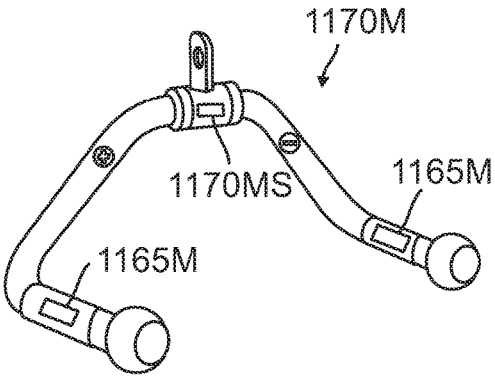
FIG. 23 is a perspective view of a variation of a multi-exercise bar including gripping sensors, plus/minus load variation buttons, and a display screen with readable surface.

Referring to FIG. 23, there is illustrated a perspective view of a multi-exercise bar 1170M with gripping sensors

1165M, plus/minus buttons for increasing and decreasing resistance, and a display screen with readable surface 1170MS.

Figure 24:
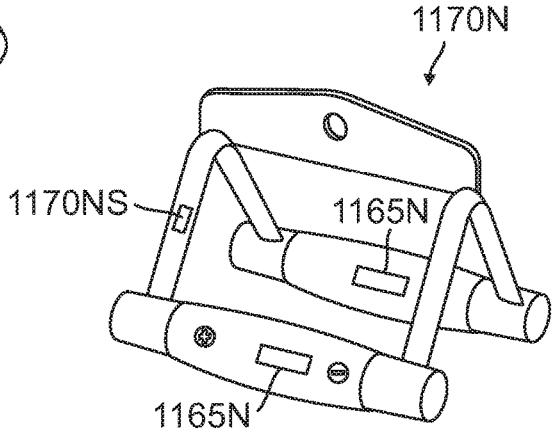
FIG. 24 is a perspective view of a double D-handlebar including gripping sensors, plus/minus load variation buttons, and a display screen with readable surface.

Referring to FIG. 24, there is illustrated a perspective view of a double D-handlebar 1170N with gripping sensors 1165N, plus/minus buttons for increasing and decreasing resistance, and a display screen with readable surface 1170NS.

Figure 25:
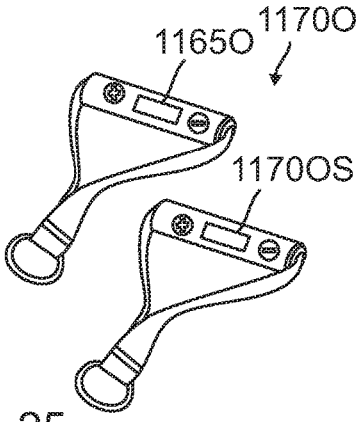
FIG. 25 is a perspective view of a cable strap handlebar including gripping sensors, plus/minus load variation buttons, and a display screen with readable surface.

Referring to FIG. 25, there is illustrated a perspective view of cable strap handles 1170O with gripping sensors 1165O, plus/minus buttons for increasing and decreasing resistance, and a display screen with readable surface 1170OS.

Figure 26:
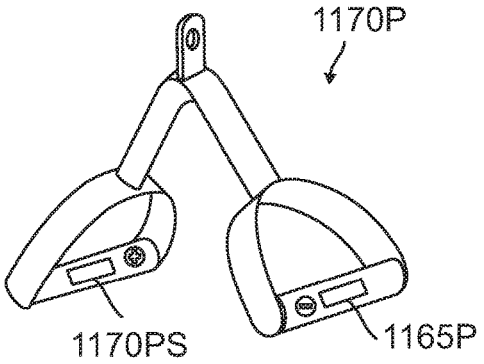
FIG. 26 is a perspective view of a narrow grip lat bar including gripping sensors, plus/minus load variation buttons, and a display screen with readable surface.

Referring to FIG. 26, there is illustrated a perspective view of a narrow grip lat bar 1170P with gripping sensors 1165P, plus/minus buttons for increasing and decreasing resistance, and a display screen with readable surface 1170PS.

Figure 27:
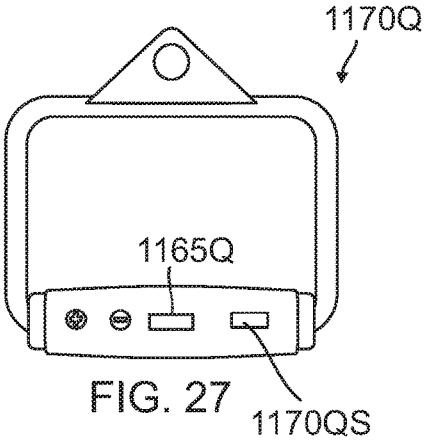
FIG. 27 is a perspective view of another variation of a D-handlebar including gripping sensors, plus/minus load variation buttons, and a display screen with readable surface.

Referring to FIG. 27, there is illustrated a perspective view of a variation of D-handlebar 1170Q with gripping sensors 1165Q, plus/minus buttons for increasing and decreasing resistance, and a display screen with readable surface 1170QS.

Figure 28:
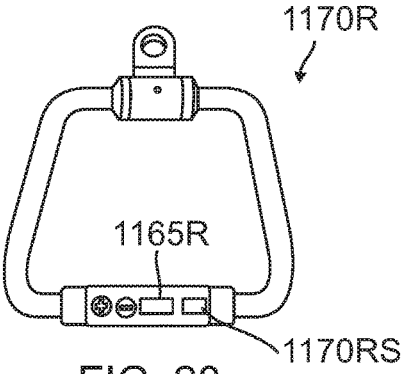
FIG. 28 is a perspective view of another variation of a D-handlebar including gripping sensors, plus/minus load variation buttons, and a display screen with readable surface.

Referring to FIG. 28, there is illustrated a perspective view of a variation of a D-handlebar 1170R with gripping sensors 1165R, plus/minus buttons for increasing and decreasing resistance, and a display screen with readable surface 1170RS.

Figure 29:
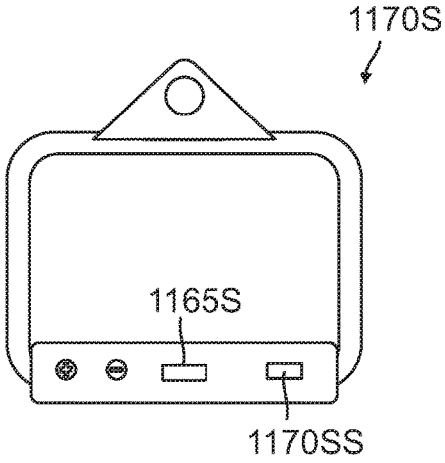
FIG. 29 is a perspective view of another variation of a D-handlebar including gripping sensors, plus/minus load variation buttons, and a display screen with readable surface.

Referring to FIG. 29, there is illustrated a perspective view of a variation of a D-handlebar 1170S with gripping sensors 1165S, plus/minus buttons for increasing and decreasing resistance, and a display screen with readable surface 1170SS.

Figure 30:
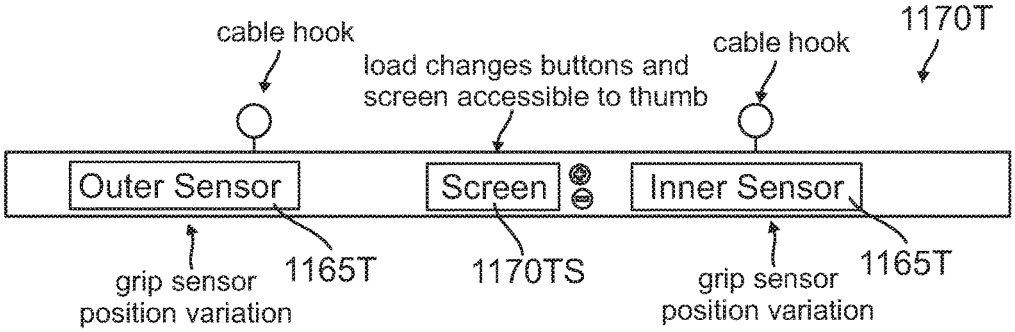
FIG. 30 is a perspective view of a barbell including gripping sensors, plus/minus load variation buttons, and a display screen with readable surface.

Referring to FIG. 30, there is illustrated a perspective view of a barbell 1170T with gripping sensors 1165T, and plus/minus buttons for increasing and decreasing resistance, and a display screen with readable surface 1165TS.

It will be appreciated that these are illustrative of various handles that can be incorporated into the present invention as discussed above. The plus button is for increasing resistance and the minus button is for decreasing resistance. The sensor grips have previously been discussed. The display screen has also previously been discussed.

While a particular form of the invention has been illustrated and described, it will be apparent that various modifications can be made without departing from the spirit and scope of the invention. For example, the shape of the enclosure as shown in the drawings may be varied considerably and still meet the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor reserves the right to add additional claims after filing the application to pursue such additional claim forms for other aspects of the invention.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A portable exercise device comprising:

a. a rigid enclosure having an outer wall that defines an internal space therein, the rigid enclosure including a first cable aperture and a second cable aperture, a preset resistance setting adjuster on an exterior surface of said rigid enclosure, an electronic command circuit board within said internal space, a motor also within said internal space, and a source of power to provide power to the electronic command circuit board;

b. a shaft rotatably affixed within said rigid enclosure, both a first spool and a second spool, separate from the first spool, affixed around said shaft and rotatable when said shaft rotates, a first flange affixed to said shaft and positioned to one side of said first spool, a second flange affixed to said shaft and positioned between and separating the first spool from the second spool, a third flange affixed to said shaft and located on a side of the second spool remote from said first flange, whereby the first and second flanges are respectively on opposite sides of the first spool and the second and third flanges are respectively on opposite sides of the second spool, wherein each of the first flange, the second flange and the third flange rotate when said shaft and said first spool and said second spool rotate;

c. a first cable wrapped around said first spool and extending through the first cable aperture and affixed at a distal end to a first grip element, a second cable wrapped around said second spool and extending through the second cable aperture and affixed at a distal end to a second grip element, pulling on each of said first cable and said second cable via the first and second grip elements, respectively, causes said shaft, said first spool, said second spool, said first flange, said second flange, and said third flange to rotate in a first direction;

d. a sensor target affixed to and rotatable with a rotatable member selected from a group consisting of said shaft and at least one of said first flange, said second flange, and said third flange; and e. a proximity sensor in visual communication with said sensor target, said proximity sensor detects rotation of said sensor target and upon detection of the rotation of said sensor target, said proximity sensor transmits a first signal to said electronic command circuit board which transmits a second signal to said motor which creates a preset resistance setting on said shaft which provides a preset resistance to each of said first cable and said second cable when each respective cable is unwound from each respective spool.

2. The portable exercise device in accordance with claim 1, further comprising: said proximity sensor and said sensor target are in direct visual communication and the proximity sensor must have a direct line of sight with the sensor target to detect when said sensor target is rotating, and when said sensor target moves out of the direct line of sight of the proximity sensor, then the proximity sensor transmits said first signal to said electronic command circuit board.

3. The portable exercise device in accordance with claim 2, further comprising: said proximity sensor is adjacent to said motor and visually aligned with said sensor target affixed to said shaft.

4. The portable exercise device in accordance with claim 2, further comprising: said proximity sensor is adjacent to said electronic command circuit board and an opening in a wall through which said shaft extends that enables the proximity sensor to be visually aligned with said sensor target when said sensor target is also affixed to said first flange.

5. The portable exercise device in accordance with claim 1, further comprising:

a. said first flange is in a round shape or in a polygonal shape selected from the group consisting of triangular, rectangular, pentagonal, hexagonal, and octagonal;

b. said second flange is in a round shape or in a polygonal shape selected from the group consisting of triangular, rectangular, pentagonal, hexagonal, and octagonal; and c. said third flange is in a round shape or in a polygonal shape selected from the group consisting of triangular, rectangular, pentagonal, hexagonal, and octagonal.

6. The portable exercise device in accordance with claim 1, further comprising:

a. said first grip element includes a first ellipsoidal-shaped end at a first end connected via a cylindrical gripping member to a second ellipsoidal-shaped end, and a semicircular support arm having a semicircular-shaped connection member that connects to a ring having an opening to allow a distal end of said first cable to attach to the ring; and b. said second grip element includes a first ellipsoidal-shaped end at a first end connected via a cylindrical gripping member to a second ellipsoidal-shaped end, and a semicircular support arm having a semicircular shaped connection member that connects to a ring having an opening to allow a distal end of said second cable to attach to the ring.

7. A portable exercise device comprising:

a. a rigid enclosure having an outer wall that defines an internal space therein, the rigid enclosure including a first cable aperture and a second cable aperture, a preset resistance setting adjuster on an exterior surface of said rigid enclosure, an electronic command circuit board within said internal space, a motor also within said internal space, and a source of power to provide power to the electronic command circuit board;

b. a shaft rotatably affixed within said rigid enclosure, both a first spool and a second spool, separate from the first spool, affixed around said shaft and rotatable when said shaft rotates, a first flange affixed to said shaft and positioned to one side of said first spool, a second flange affixed to said shaft and positioned between and separating the first spool from the second spool, a third flange affixed to said shaft and located on a side of the second spool remote from said first flange, whereby the first and second flanges are respectively on opposite sides of the first spool and the second and third flanges are respectively on opposite sides of the second spool, wherein each of the first flange, the second flange, and the third flange rotate when said shaft and said first spool and said second spool rotate;

c. a first cable wrapped around said first spool and extending through the first cable aperture and affixed at a distal end to a first grip element, a second cable wrapped around said second spool and extending through the second cable aperture and affixed at a distal end to a second grip element, pulling on each of said first cable and said second cable via the first and second grip elements, respectively, causes said first spool, said second spool, said first flange, said second flange, and said third flange to rotate in a first direction;

d. a sensor target affixed to and rotatable with a rotatable member selected from a group consisting of said shaft and at least one of said first flange, said second flange and said third flange; and e. a proximity sensor in wireless communication with said sensor target, said proximity sensor detects rotation of said sensor target and upon detection of the rotation of said sensor target, said proximity sensor transmits a first signal to said electronic command circuit board which transmits a second signal to said motor which creates a preset resistance setting on said shaft which provides a preset resistance to each of said first cable and said second cable when each respective cable is unwound from a respective spool.

8. The portable exercise device in accordance with claim 7, further comprising: said wireless communication is by radio frequency.

9. The portable exercise device in accordance with claim 8, further comprising: each of said first grip element and said second grip element includes a first ellipsoidal-shaped end at a first end connected via a cylindrical gripping member to a second ellipsoidal-shaped end, the cylindrical gripping member including a gripping sensor on the cylindrical gripping member, wherein a compression force on the cylindrical gripping member is applied to the gripping sensor which generates a communication through the radio frequency to the electronic command circuit board to cause the motor to activate and turn on creating resistance, and wherein when the compression force is released, this creates a decompression of the compression force on the gripping sensor which generates a communication through the radio frequency to the electronic command circuit board to cause the motor to turn off.

10. The portable exercise device in accordance with claim 9, further comprising: each of said first grip element and said second grip element includes said second ellipsoidal-shaped end having a display screen with a readable surface adjacent to a plus or increase tension button and a minus or decrease tension button, a circuit board located in each second ellipsoidal-shaped end, the circuit board including a wireless communication device selected from a group consisting of a transmitter and a transceiver to communicate with said electronic command circuit board to increase or decrease the preset resistance setting from the shaft provided by the motor.

11. The portable exercise device in accordance with claim 7, further comprising: at least one grip member selected from a group consisting of a lat bar, a curl bar, a narrow grip lat bar, a V-bar, a straight bar, a rope, a triceps rope, a multi-exercise bar, a double D-handlebar, a cable strap handlebar, a narrow grip lat bar, and a barbell.

* * * * *